US005218795A

United States Patent [19]

Horstketter

[11] Patent Number: 5,218,795

[45] Date of Patent: Jun. 15, 1993

[54] CONCRETE PANELS, CONCRETE DECKS, PARTS THEREOF, AND APPARATUS AND METHODS FOR THEIR FABRICATION AND USE

[76] Inventor: Eugene A. Horstketter, P.O. Box 441282, Houston, Tex. 77244

[21] Appl. No.: 599,306

[22] Filed: Oct. 17, 1990

Related U.S. Application Data

[63] Continuation-in-part of Ser. No. 388,475, Aug. 2, 1989, Pat. No. 4,982,538, which is a continuation-in-part of Ser. No. 83,663, Aug. 7, 1987, abandoned.

[51] Int. Cl.[5] ..... E04B 1/00; E04B 1/38

[52] U.S. Cl. ..... 52/125.5; 52/126.5; 52/252; 52/259; 52/706

[58] Field of Search ..... 52/125.5, 125.2, 126.6, 52/126.5, 704–707, 340, 250–259; 404/48; 264/31–35; 425/19, 21, 25

[56] References Cited

U.S. PATENT DOCUMENTS

| | | | |
|---|---|---|---|
| 1,108,859 | 8/1914 | Bennett | 52/705 |
| 2,940,784 | 6/1960 | Fell | 52/126.5 |
| 3,106,803 | 10/1963 | McRobbie | 52/125.5 |
| 3,195,278 | 7/1965 | Ballou | 52/125.5 X |
| 3,367,620 | 2/1968 | Holt | 52/706 X |

FOREIGN PATENT DOCUMENTS

| | | | |
|---|---|---|---|
| 684253 | 3/1965 | Italy | 52/125.5 |
| 1199373 | 7/1970 | United Kingdom | 52/125.5 |

*Primary Examiner*—Richard E. Chilcot, Jr.
*Attorney, Agent, or Firm*—Vaden, Eickenroht, Thompson, Boulware & Feather

[57] ABSTRACT

Concrete panels for making concrete decks or floors for spanning between structural supports; parts of such panels including shear connectors, thread formers, and resilient grout seals; tools for manipulating grout-seals; co-acting forms for making panels; interior and overhang panels and apparatuses and methods for fabricating and using such panels. The panels have a seal member device connected to a body member for sealing off a space between the panel and a structural support on which the panel rests.

10 Claims, 25 Drawing Sheets

CONCRETE PANELS, CONCRETE DECKS, PARTS THEREOF, AND APPARATUS AND METHODS FOR THEIR FABRICATION AND USE

BACKGROUND OF THE INVENTION

This application is a continuation-in-part of my copending application, Ser. No. 07/388,475, filed Aug. 2, 1989, now U.S. Pat. No. 4,982,538 and entitled "CONCRETE PANELS, CONCRETE DECKS, PARTS THEREOF, AND APPARATUS AND METHODS FOR THEIR FABRICATION AND USE", which was a continuation-in-part of my then copending application, Ser. No. 07/083,663, entitled "CONCRETE PANELS, CONCRETE DECKS, PARTS THEREOF, AND APPARATUS AND METHODS FOR THEIR FABRICATION AND USE", filed Aug. 7, 1987, and now abandoned.

FIELD OF THE INVENTION

This invention is related to: concrete panels for use in making concrete decks or floors for spanning between structural supports, e.g. pre-cast, pre-stressed concrete panels for constructing reinforced concrete decks for bridges supported by structural beams; parts of such concrete panels, e.g. shear connectors, thread formers, and resilient anchored grout seals; tools for manipulating resilient grout seals; co-acting forms for producing the panels; interior and overhang panels; and apparatus and methods for fabricating and using the panels.

DESCRIPTION OF THE PRIOR ART

The construction of reinforced concrete decks and floors (e.g. on bridges and in buildings) has always been the most labor intensive and most costly component of the superstructure involved, and has been the component that controls the overall rate of progress of the construction. The need for temporary support of the reinforcing steel and freshly poured concrete until the concrete has attained sufficient strength to support itself is a major factor in the cost of such construction. The length of time such support must remain in place to allow the concrete to attain sufficient strength is the major factor in controlling the rate of progress of the structure.

The original method used in modern times to provide the temporary support was a basic wood form made up of boards or plywood sheeting nailed to wood joist members, carried on wood timbers or steel beams, which in turn were supported on posts or columns from the ground or lower completed floor. This method is still used today with the development of a variety of complex high capacity column scaffolding systems and beam members that are adjustable for both span length and camber. Other developments in the use of the basic wood form include hanger systems that provide for hanging the form from the beam members of the permanent structure, thereby eliminating the need of posts or columns from below. This development includes hanging brackets to provide for support of deck or floor that cantilevers off of these beams. Another development involved trussed framing systems that provided for the support of large areas of form on a very few bearing supports, and for the removal and re-setting of such large areas as a single unit.

The cost of using basic wood forms would be prohibitive if they were used just once, but they are normally not consumed or destroyed in a single use and are in fact in normal practice re-used many times before wear and tear makes them unfit for further re-use. The greater the number of re-uses of the forms, the more economical they become. Economics therefore dictates that the effort on any given construction project is to provide the minimum quantity of form that will permit reasonable progress to be achieved on the project, thereby gaining the greatest number of re-uses, even though availability of a greater quantity of form would provide for a faster rate of progress.

The setting of wood forms preparatory to the placement of reinforcing steel and concrete is a labor intensive task by itself, but removing wood forms after the concrete has attained sufficient strength, usually requiring extensive scaffolding, requires a greater amount of costly labor and equipment, and the moving to the location of its next use and the clean up and preparation for re-use of the forms adds more labor and equipment cost.

These high labor and equipment costs, and the limitation of progress inherent in the use of wood forms, has encouraged development of alternate methods of providing support for deck and floor construction. The development of methods using materials that are durable, yet economical enough to be used once and then left in place, are gaining in favor. Some methods provide temporary support only and after the concrete has gained its strength and are simply left idle in place. Light gage galvanized corrugated sheet steel panels supported directly by the permanent structure beams is the most popular of these methods.

Some methods provide temporary support but in addition become an integral permanent working part of the structure when the concrete gains its strength. Heavy gage corrugated sheet steel panels, supported directly by the permanent structure beams, with steel loop shear connectors connected (e.g. by welding) to the panels and then embedded in the concrete to make the panels and the cured concrete work as a composite unit is one example of this method. The most recent development in this area is the pre-cast pre-stressed concrete panel supported directly by the permanent structure beams, and again with shear connectors to make the panels and the cast-in-place concrete work as a composite unit. These panels replace the wood forms and serve both as a form and then as an integral part of the structure. A desired amount of concrete is poured onto the already-formed and already-hardened panel.

In becoming a permanent composite component of the structure, the panels replace structural materials that would otherwise have to be provided in the design of the structure. In the case of the sheet steel panels, part of the reinforcing steel is replaced by the panel. In the case of the pre-stressed concrete panel, part of the reinforcing steel and a substantial part of the concrete is replaced by the panel.

In exposed structures such as bridges, the concrete panels are popular with engineers and architects because they blend in with the appearance of the structure and provide the most natural look. Another important reason is that they are not subject to corrosion that might diminish the appearance of the structure at some later date, or even become a hazard by falling from the structure as sheet steel might do.

The currently popular design of pre-stressed concrete panels leaves serious and costly problems in the construction technique. To accomplish the composite relationship between the panel and the cast-in-place concrete, the first requirement is that the panel have a continuous rigid bearing contact with the top of the supporting beam along its ends. Since neither the top of the beam or the bottom of the panel can be depended upon to be perfectly flat, an intervening material, normally concrete or cement grout, that can be installed in a plastic state so it will conform to both surfaces and then harden in that shape is required. General practice (see FIG. 1) is to place a narrow strip of fiberboard along the edges of the top flange of the supporting beam, to set the concrete panel thereon so the panel overhangs the fiberboard strip over the beam, and then to either force the intervening material in its plastic state under the overhanging part of the panel, or to wait until the cast-in-place concrete is poured and at that time to force grout contained in the concrete mix being used to flow under the overhanging part of the panel. The fiberboard is of sufficient thickness to allow room for the intervening material to be forced under the overhanging part of the panel, and it prevents the plastic material from flowing over the edge of the beam. The fact that the two surfaces are substantially parallel and close together requires substantial effort and great care to insure that this important requirement is actually accomplished, and that no air pockets are entrapped that would reduce the bearing area.

To provide for the deflection of the beams and the design cambers that are required to provide the desired finished grading, the designer and/or the constructor is left with three undesirable options in the use of this method. The thickness of the fiberboard material (or other filler or sealing material) can be varied to compensate for deflection and camber which allows the thickness of the slab to remain constant; the thickness of the slab can be varied to provide the desired top surface grading while the bottom surface follows the deflection of the beams; or the top surface of the beams can be re-graded to provide for deflection and camber with a cast-in-place concrete overlay prior to the placement of the fiberboard strips.

If the thickness of the fiberboard strip is varied, (see FIG. 1) measurement and placement of the strips according to a pre-calculated layout must be done by workmen working on top of the bare beams before the panels can be placed. This is slow and dangerous work, and completed work can easily be knocked or blown off of the beam, and at best the amount of variation that can be accomplished is very limited because excessive thicknesses of the fiberboard become unstable. Methods of using concrete bricks under the panels along with galvanized sheet steel (see FIG. 3) to close the opening between the panel and the top of the beam between bricks are available, but are extremely labor intensive and time consuming. There is no way to adjust panels after they are in place, so if errors are discovered at this time the only way to make corrections is to remove the panels and start over.

If the thickness of the slab is varied, all the variation must be in added thickness, since design requirements are minimum thickness. The cost of the excess concrete is a complete loss and again the amount of variation that can be accomplished is very limited because too much excess material would add too much dead load to the slab and the structure.

Re-grading of the top surface of the beam (see FIG. 2) provides satisfactory results, but is clearly the most costly and time consuming of all of the options.

None of the currently used methods have attempted to improve on or replace the use of the basic wood form to support the overhanging portion of decks or floors. Therefore structures that are designed with overhanging deck or floor currently have the progress limitation problem of the basic wood form, even if other non-restrictive methods of support are used between beams.

The facilities for casting pre-stressed concrete panels consists of a pair of anchorages used to anchor the ends of the pre-stressing strands, with a fixed flat surface between them on which the concrete is poured, and usually with fixed side forms the full length of the flat surface to contain and shape the concrete on the sides of the panels. The most expensive part is the anchorages which must be capable of withstanding tremendous horizontal loads as the pre-stressing strands are stretched between them. The anchorages are therefore usually spaced far apart, and the casting beds are very long (e.g. 300–600 feet) and narrow (e.g. 8 feet wide) so as to provide the greatest possible amount of casting capacity for the pair of anchorages.

Once the casting bed is established, the work of casting the typical panels involves the placing and stressing of the strands, the setting of forms which divide the long bed into the lengths of panels required, and the placing of reinforcing steel and the pouring of the concrete. After the concrete has cured, the strands are released from the anchorages and cut at each form, and the panels are removed from the bed. The setting and removing of the forms is clearly the most difficult of these tasks. The form must have two faces against which the concrete is poured and through which all the strands must pass. The strands are usually spaced on approximately six inch centers across the full width of the bed at mid-depth of the panels. The two faces of the form are spaced apart to provide for the strands to be exposed between panels so that after they are cut, a required length will extend out of the end of each panel to provide anchorage into the cast-in-place concrete when the panel is installed in the bridge or building. Since the strands effectively divide the faces into two halves, the two faces are usually split longitudinally so the lower half can be set below the strands, before the strands are installed, while the upper half is set above the strands, after they are installed. Holes must be provided along the joint between the top and bottom halves of the form with a close enough fit to the strands to prevent excessive grout leakage, and the top and bottom halves must be fixed in alignment at the joint. The forms must be maintained in their selected positions to resist the forces of the concrete being poured against them and the space between the two faces must be covered to prevent it from being filled with concrete. In current practice the typical divider form is made up of a bottom board or a steel channel with wood filler of a width equal to the required space between concrete faces, a thickness equal to the space under the strands, and a length equal to the width of the casting bed. Wood boards the width of the bottom member of a thickness equal to the diameter of the strands, and a length equal to the space between strands, are nailed to the top form, to fill the space between strands and provide a notch for each strand at the proper locations. The top board of the same dimensions as the bottom form is nailed or bolted in place over the strands after they have been placed and stressed.

The pre-cast pre-stressed concrete panels that are in use for deck and floor construction today eliminate some of the need for labor intensive temporary wood support forms to be furnished, set in place, and later removed and prepared for re-cycling. The "set in place one time and never go back" use and therefore the elimination of the need to re-cycle the support means as with temporary wood forms permits the constructor to economically work a much larger area of deck or floor at one time, the only limitation being the re-cycling of the support forms for the overhanging part of the slab. Labor crews and equipment can be utilized more efficiently and progress of the deck or floor is substantially improved. But for all their advantages, there remain distinct problems in the way they are used today. Pre-grading and erecting them in place, especially the pre-grading, is highly labor intensive; forcing grout or concrete under the ends of the panels is difficult; and on structures with substantial overhanging slab area, such as bridges, the overhanging area is dealt with using the basic re-cycling wood form. There has been a long-felt need for efficient and economical apparatuses and methods for casting concrete panels and for making a concrete deck to span structural supports. There has also been a long-felt need for such a deck that is quick to set and easy to grade. The present invention meets and satisfies these needs.

Traffic loads are distributed longitudinally and transversely within the interior areas of the span of a reinforced concrete highway bridge deck or similar structure. However, such loads are distributed transversely only at the ends of a span so that the deck slab at the ends of spans must be supported by a transverse beam or be made stronger. In continuous slab bridges, where two or more spans are connected together and designed to work as a single unit, deflection and deformation induce maximum stress in the deck slab requiring special attention at the interior support points. The currently popular method of providing for meeting these conditions, when precast concrete decking panels are used in the deck construction, is to make the deck slab thicker at the ends of the spans and to use additional longitudinal reinforcing steel at the interior support points. The slab is therefore constructed of full depth cast-in-place concrete in these areas.

The full depth cast-in-place concrete slab requires a support which, as previously described, currently involves the use of a temporary wood form or the use of stay-in-place sheet metal forms. In either case, an extra source of material supply must be dealt with, and separate labor crews of different skills, working at separate times, and with separate equipment, must be employed. There is a need for, and thus an object of this invention, to provide an efficient and economical method to provide for the special requirements in these critical areas using the same source of supply, the same labor crew and equipment as the previously described decking panels.

In accordance with 37 C.F.R. §§1.56 and 1.97, the following references are disclosed:

1. Dayton Superior Bridge Deck Forming Handbook, 1985, which discloses various prior art hangers, decks, overhang brackets, guardrails, precast girders, screed supports, and reinforcing bars.
2. Dayton Superior Precast—Prestressed Concrete Handbook 1986 which discloses various prior art inserts, anchors, braces, and bolts.
3. CMI News, Spring 1982, discloses prior art deck methods.
4. Superior Bridge Deck Forming Handbook, 1977, discloses various prior art hangers, brackets and various methods for making decks.
5. Texas Highway Department Bridge Division, Prestressed Concrete Panels Optional Deck Details, 1980, Sheets 129 Band C, discloses prior art panels and methods for making decks.
6. U.S. Pat. No. 122,498 discloses a method for making concrete pavement.
7. U.S. Pat. No. 1,004,410 discloses apparatus for laying concrete.
8. U.S. Pat. No. 1,751,147 discloses a method of lining tunnels with concrete.
10. U.S. Pat. No. 3,646,748 discloses a tendon for prestressed concrete.
11. Russian Patent 502,076 discloses bridge surface concreting machines.

None of these references taken alone or in any combination teaches or suggests the present invention.

SUMMARY OF THE PRESENT INVENTION

The present invention is directed to apparatuses and methods which solve the problems of the prior art and provide the means to set pre-cast pre-stressed concrete panels that span between beams directly on the supporting structural beams with no prior preparation; to adjust the grade of the panels to provide for deflection and camber over a wide range of adjustment before or after setting with little or no loss of material; and to cast the panels with improved bulkhead forms and screw jack hardware. It further provides the means to extend the use of pre-cast pre-stressed concrete panels to the overhanging parts of decks or floors.

In the pre-cast concrete deck panels of this invention, threaded bolts are used to support and provide adjustability of each panel. The seal that contains the grout or concrete that is forced between the bottom of the panel and top of the supporting beam slides on the edge of the beam and is capable of maintaining its sealing action over a wide range of adjustment of the space between the two. At any stage prior to pouring concrete on a panel, the bolt can be adjusted upwardly (or downwardly) and the grout seal will extend sufficiently that the seal between the beam and the panel will be maintained. The grout seal also acts as a concrete form and is capable of resisting the horizontal pressure of the plastic grout or concrete poured against it and thereby prevents it from simply flowing over the edge of the beam. The present invention provides these capabilities with a strip of material, preferably plastic, one portion of which can be secured to or embedded into the bottom of the concrete panel, in the casting bed, on a line that will fall approximately over the edge of the supporting beam when the panel is erected.

In the erection procedure, the strip is positioned to bear against the side of the flange of the supporting beam for the full length of the panel. The preferred plastic is a stiff pliable material (e.g. polypropylene polyurethane or polvinyl chloride) that resists bending but will bend to a high deflection without splitting or cracking, and without deformation so that it will spring back to its original position if not restrained from doing so. In pre-casting the panels the strip can be positioned horizontally on the bottom of the panel with the one edge embedded in the concrete. To gain an improvement in the placement of the grout or concrete under the part of the panel that overlaps the support beam, the strip can be shaped for and positioned to slope up from the embedded edge of the strip to the underside of the strands at the end of the panel. In this way the panel bottom is formed with a slope up from the edge of the supporting beam to the end of the panel so the space between the top of the beam and the overlapping panel, when the panel is installed, forms an open mouthed recess into which grout or concrete can easily flow and from which air can easily escape.

A two-piece co-acting bulkhead form can be used to insure that the plastic strip is held in true position during the concrete pouring operation. The bottom part of the bulkhead form is made with a narrow level surface edging on the face of the form and just under the strands, extending the width of the panel. A matching narrow level extension, with a short turn down at its outer edge, is made a part of the plastic strip.

In preparing the casting bed for a pour, the bottom bulkhead form is set in place in the bed, and the plastic strips are set to it with the narrow level extensions laying on the level surface of the form, and with the short turn down hooked over the inside edge of it. The top bulkhead form is made to set on top of the level extension, between the strands, and with a vertical faced projection extending below the level bearing area that in turn bears against the short turn down of the plastic strip. In this way the top and bottom bulkhead forms can be secured together with the strip firmly held between them.

In the instances where the designer requires the bearing area of the panel to be level, or near level, the plastic strip can be shaped flat. The strip is of a width that will provide for the embedded edge to be positioned over the edge of the supporting beam while the opposite edge extends a short distance beyond the end of the panel to provide for the plastic strip to be held in true position during the concrete pouring operation and to provide a starting tab for bending the plastic strip down in the erection procedure.

To complete the means of holding the plastic strip in true position during the concrete pouring operation, the outer edge of the strip can be turned up. When installed in the casting bed the turned up edge is positioned to extend up into a groove which can be provided in the bottom of the bottom bulkhead form. A short upward protrusion can be spaced back from the outer edge of the plastic strip so it will position just outside of the bottom form to provide an additional holding support and a sight line to assist in quick installation in the casting bed. The bulkhead forms are preferably made of a plastic to which concrete will not bond, e.g. polyurethane, or polyethylene.

A new shear connector is provided to overcome the shearing stress in a beam member and reinforcing a joint in the shear plane. The sliding between two beams one on the other can be characterized as "shear" (such as between a panel and cast-in-place decking on the panel). A shear connector provides a strengthening connection between two such members which overcomes or reduces shear.

To provide for the convenient use of the threaded bolts to be used as adjustable legs for the individual panels that span between structure beams, threaded holes can be formed through one embodiment of panels according to this invention in the casting bed in at least four places. The holes are located to pass through the part of the panel that overhangs the supporting beams so the bolts that pass through them will bear on the beams, and along the length of the panel on the center line between two strands that falls nearest the quarter points of the length. The holes are preferably formed with molded plastic tubing which has been formed to the shape of the thread to be used. Light gauge sheet steel tubing, or a solid or wire nut with formed holes above and below, may be used. To assure that the hole remains plumb and in the correct position throughout the pouring of the panel concrete, securement fixtures with arms of sheet steel, steel wire, or plastic can be attached to the thread forming tubing and, extend and attach to the strand on each side, and a gauging means can be provided to fix the distance from the bulkhead form. By this means the hole forming tubing can be installed in the casting bed and embedded along with the edge of the seal strip as the concrete is poured.

When panels are to be delivered to the structure on which they are to be used, the strips can be moved with the use of a seal depressor that includes one or more curved tines mounted to a rotatable shaft that is located above the panel over the line of the embedded edge of each grout seal strip. Preferably a plurality of tines are used and preferably each tine is a three sided rectangular loop of wire, both ends of which are rigidly mounted to its rotatable shaft. The tines are curved to wrap around the ends of the panel in such a way that when rotated downward they will bear on the narrow level surfaces of the grout seal plastic strips, and upon further downward rotation, push the grout seal strips past the vertical position and thereby position them to pass down between the two supporting beams as the panel is lowered into position. The tines can be located to avoid the threaded bolt leg positions and to pass between strands.

In one embodiment, the seal depressor includes apparatus designed to automatically attach to a panel, activated by the vertical hoisting action of a handling crane, to lift the panel from storage or a delivery vehicle, and to simultaneously depress the seal strips from the horizontal unstressed state as cast, and against their inherent spring resistance, and rotate it to a position that makes it easy to lower the strips down between two adjacent bridge beams as the panel is lowered to its functional position supported above the bridge beams. Once the panel is resting on its temporary supports over the bridge beams, the seal depressor is released from the panel and the seal strips are simultaneously released to spring back against the sides of the bridge beams for a purpose previously described.

The threaded bolt legs can be inserted in the threaded holes at any time after casting, but if not done before erection, they are inserted while the panel is hanging in the lifting frame The bolt legs can be extended to precalculated lengths to provide required deflection and camber adjustment at this time, or the panel can be set on the supporting beams, with enough clearance for the rotated tines, and later jacked up to the proper adjustment by rotation of the threaded bolt legs. It is preferred that the grout seal strips are resilient enough and springy so that when they are released they press against the sides of the beams with spring action of sufficient force to resist the horizontal pressures of the grout or concrete to be placed under the panel later. It is also preferred that the grout seal strips' dimensions are such that any adjustment of the panel for grade simply slides the beam seal up or down on the side of the top flange of the supporting beam.

The use of pre-cast concrete deck panels on the overhanging part of the slab has a different set of conditions.

Since the overhang is supported by a single structure beam, a pre-cast panel must be supported by the same single beam. The means provided herein to support the pre-cast panel on the overhang, therefore, is with the use of a stable overhang bracket which is hung from the structural beam. The preferred bracket is primarily used to support a rail along the bridge that is designed to carry an assortment of rolling construction equipment used in the setting of the panels and reinforcing steel, and in pouring, shaping, grading, and finishing the cast-in-place concrete. The bracket is adjustable for grade and slope and therefore provides for the necessary pre-grading to adjust for deflection and camber. This bracket construction is more completely described and shown in my U.S. Pat. No. 4,660,800 entitled "Bridge Overhang Bracket and Hanger", Apr. 28, 1987, which patent is incorporated herein for all purposes. By this method the panels for the overhang span from bracket to bracket alongside the structural support beam rather than from beam to beam.

With the fundamental advantages of the use of precast concrete panels on the overhand established, and the basic application and method of support and adjustment provided for, two specific panel designs are needed to provide for two different structure designer requirements. The efficiency and safety of the traffic control barrier on the overhanging edges of most federal highway bridges, and the stresses that develop therefrom have been established through extensive and costly full scale testing programs sponsored by the Federal Government. This same program has established specific designs for the overhanging portion of applicable highway bridge decks and in this case, no basic design variation is normally considered. A precast panel that changes only the construction procedure and minor details is necessary. Alternately, a pre-stressed concrete panel that allows for greater flexibility in its application is desirable.

To provide for the case where the design of the overhang is predetermined and only the construction procedure is to be improved by the use of precast concrete panels, the panels are designed with a width to overhang the top flange of the structural beam, as with the interior panels, and, to avoid an unsightly horizontal joint, with the full outside face of the overhand as its outer edge. Horizontal adjustability is provided for variable overhang widths in curves and turn outs, and again for tolerance by variation of the distance the panel overhangs the structural beam. The panels are designed with a length equal to the spacing of the supporting overhang brackets, less a short distance to allow space for end-to-end misalignment necessary to install the panels on horizontal and vertical curves, and again for tolerance. In the erection of the panels the gap so created can be filed with a flexible, compressible material such as plastic foam to prevent grout leakage.

In order to maintain predetermined structural design, as a minimum, all of the reinforcing steel called for in the applicable structure design, any part of which falls within the volume occupied by the panel concrete, can be cast into the panel in the casting yard. Additional reinforcing steel, or pre-stressing strands, may be added to provide for shear connection between the panel and the cast-in-place concrete to insure that they act as a composite unit, for handling, and for spanning between overhang brackets while the panel serves as the support form.

Panels can be provided according to the present invention which have as an integral part thereof some or all of the steel necessary to effect the designed deck or floor.

To provide the grout seal between the bottom of the panel and the top of the structure beam over the full range of vertical adjustment required, and to provide temporary support for the panel, an angle of either steel or plastic can be attached to the overhang brackets to span between them and is placed against the outer vertical face of the flange of the structure beam, in such a way that it adjusts vertically with the bracket (see FIG. 15). The angle is removed with the brackets after the cast-in-place concrete has cured sufficiently for the overhang to support itself.

To provide for the case where a more economical panel with greater flexibility of design is allowable, a purely pre-stressed design can be used (see FIG. 16). Since the panel spans from bracket to bracket parallel to the structure beam, the pre-stressing strands also run parallel to the beam. In this configuration, the strands serve primarily in the temporary support of the cast-in-place concrete, but the concrete of the panels works in composite action with and replaces a substantial portion of the cast-in-place concrete. Since the overhang is a cantilever in the permanent structure, the panel concrete forming the bottom portion of the cantilevering slab is stressed only in compression. And since the pre-stressed concrete is a denser stronger concrete then the cast-in-place concrete, the pre-stress loads normal to the live loads are not normally detrimental.

In accordance with a further novel aspect of the present invention, precast concrete forming panels, similar to the precast concrete decking panels used for the general deck construction, as above described, are used to provide the temporary support for the full depth cast-in-place concrete and are left in place in the same way that sheet metal forms are. Thus, the precast concrete forming panels are supported from the opposite sides of the support beams of adjacent rows so as to span the gap between them in a close fit. Each such forming panel is so supported by a hanger which comprises a beam connected intermediate its ends to the forming panel with its inner end on the top of the panel and its overhanging outer end on the top of a support beam. More particularly, and as in the case of the decking panels, bolts engage at their lower ends with the top of the support beam, whereby each such bolt may be adjusted to act as a jack screw to raise or lower the forming panel.

Holes extend on each side of the panel adjacent to the bridge support beam, and bolts extend through the holes in the panel and the hanger beam member to connect the hanger beam to the panel with its one end bearing on the panel to provide for reaction for a load imposed through the bolts at the overhanging end. In one form, the hanger beam comprises spaced metal channels connected to opposite sides of wire nuts, and, in another form, the hanger can be a molded plastic body in which the threaded holes on its outer end are integrally formed.

Thus, when the forming panels are supported between adjacent support beams, their top surfaces can be graded to the bottom elevation of the structural cast-in-place slab to be poured thereover, and thereby shape and support the cast-in-place concrete until it cures. Thereafter, the forming panels are left in place to avoid the cost and time to remove them.

It is, therefore, an object of the present invention to provide novel, efficient, and economical apparatuses and methods for forming concrete decks or floors between structural supports.

Another object of the present invention is the provision of a pre-cast concrete panel which can span between structural supports and can rest directly on the supports with no prior preparation.

Yet another object of the present invention is the provision of such panels with apparatus for adjusting the grade of the panels to provide for deflection and camber before or after setting with little loss of material.

An additional object of the present invention is the provision of a grout seal strip for such panels and of a panel with such a grout seal strip.

Another object of the invention is the provision of a grout seal strip with an anchor for embedment in a concrete panel.

Yet another object of the present invention is the provision of such a grout seal strip which is resilient and of such dimensions that it can contain grout between the panel and the support.

An additional object of the present invention is the provision of concrete panels with either a flat bottom or a partially-sloped bottom.

Another object of the present invention is the provision of such panels with threads formed therethrough for receiving a threaded bolt to provide adjustment for deflection and camber.

A further object of the present invention is the provision of a thread former for providing such threads.

Yet another object of the present invention is the provision of a seal depressor for manipulating the grout seal strips.

Another object of the present invention is the provision of a casting bed apparatus and method for employing the new bulkhead forms and for producing panels according to the present invention.

Yet another object of the present invention is the provision of a novel and efficient shear connector for mechanically connecting the cast-in-place concrete to the panel to insure that they work together as a composite unit.

A particular object of the present invention is the provision of a concrete panel which has as an integral part thereof the necessary designed steel for constructing the proposed deck or floor.

Another object of the present invention is the provision of apparatuses and methods which are creatively simple so that the possibility of errors in use and fabrication are significantly reduced; i.e., "fool-proof" apparatuses and methods such as thread formers with gage rods to insure proper placement and two-piece mating bulkhead forms which can only fit together properly in one manner.

To those of skill in this art who have the benefit of this invention's teachings, other and further features, objects, and advantages will be clear from the following description of preferred embodiments where taken in conjunction with the drawings, all of which are given for the purpose of disclosure.

DESCRIPTION OF PREFERRED EMBODIMENTS

Figure 1:
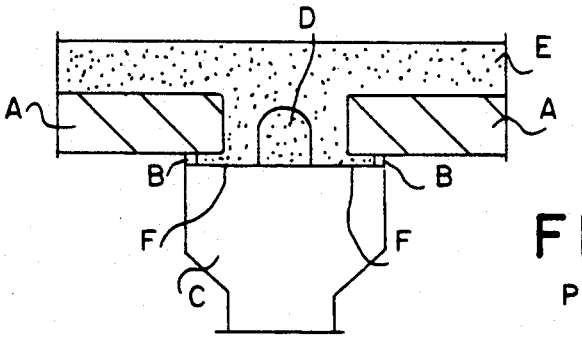
FIG. 1 PRIOR ART
FIGS. 1–3 are side cross-sectional views of prior art support beams, panels and decks.

FIG. 1 illustrates typical prior art deck forming apparatuses and methods. Concrete panels A are emplaced on fiberboard inserts B on a support beam C. A metal loop D embedded in the beam C extends up into the poured concrete deck E. Poured concrete has filled the gaps F between the panel ends and the beam's top surface.

Figure 2:
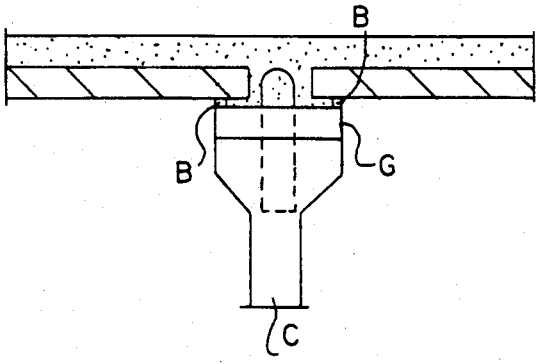
FIG. 2 PRIOR ART
Figure 3:
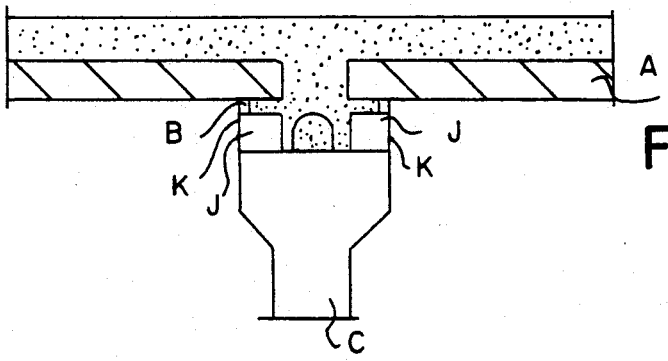
FIG. 3 PRIOR ART

FIGS. 2 and 3 illustrate additional typical prior art deck forming apparatuses and methods for use where the distance between the top of a support beam and the finished grade cannot be achieved within desired tolerances with cast-in-place slab thickness and fiberboard. In FIG. 2 additional height is provided by using a cast-in-place concrete overlay G to re-grade the top surface of the beam C. In FIG. 3 additional height is provided by emplacing concrete blocks J along the edges of the panels A. Sheet metal angles K are used between the blocks J and the panels A for the purpose of sealing the space between the panel and the top of the beam to prevent the grout or concrete from flowing over the edge of the beam between concrete blocks. Fiberboard B is used between the concrete blocks J and the panels A.

Figure 4:
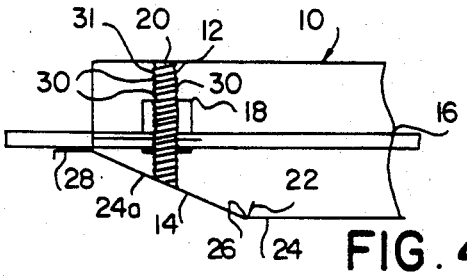
FIG. 4 is a side cross-sectional view of an end of a panel and seal strip constructed in accordance with one embodiment of the present invention.

FIG. 4 illustrates a portion of the end of a pre-cast pre-stressed concrete decking panel 10 according to the present invention. The panel 10 has a hollow thread former 12 embedded therein and a resilient grout seal strip 14 anchored therein. A strand 16 of pre-stressed steel is shown embedded in the panel 10 and passing by the thread former 12. A dual arm securement fixture 18 is disposed about the thread former 12 and is secured to the strand 16. A removable cap 20 closes off the top of the thread former 12 to prevent the influx of debris or other unwanted material into the interior of the thread former.

The thin, elongate grout seal strip 14 has an anchor 22 formed integrally thereof on its upper face and extending therefrom for anchoring the strip 14 to the panel 10. A small semicircular hinge portion 26 can be formed integrally of the grout strip 14 along its length and intermediate inner and outer elongated portions 24a and 24 of the strip on the inner and outer sides of the hinge portion, whereby the strip may be rotated about the anchor 22. The anchor means is adjacent the hinge so as to facilitate swinging of inner elongate portion 24a about the hinge. As will be described in more detail below, to facilitate emplacement of the grout strip 14 in a casting bed, the outer edge of the inner elongate portion of the grout strip 14 extends beyond the panel and is provided with an L-shaped portion 28 with the base of the L pointing down.

The exterior valleys 30 of the thread former 12 are filled with concrete when the panel 10 is cast. This reinforces the thread former 12 and holds it in place. The cap 20 is also provided with exterior valleys 31 so that continuous threads extend from the top to the bottom of the panel end. During casting of the panel, the grout seal strip 14 closes off the lower end of the thread former 12.

Figure 4A:
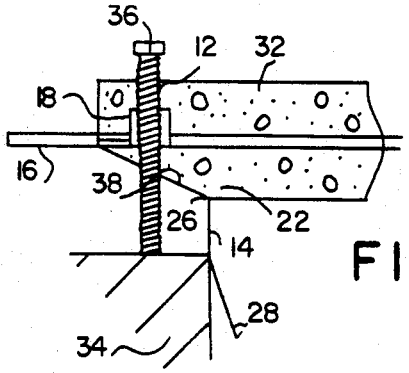
FIG. 4A is a side cross-sectional view of an end of the panel of FIG. 4 atop a support beam and with the seal strip bent to a position engaging a side edge of the panel and a bolt lowered through a thread form to space the panel above the beam.
Figure 5:
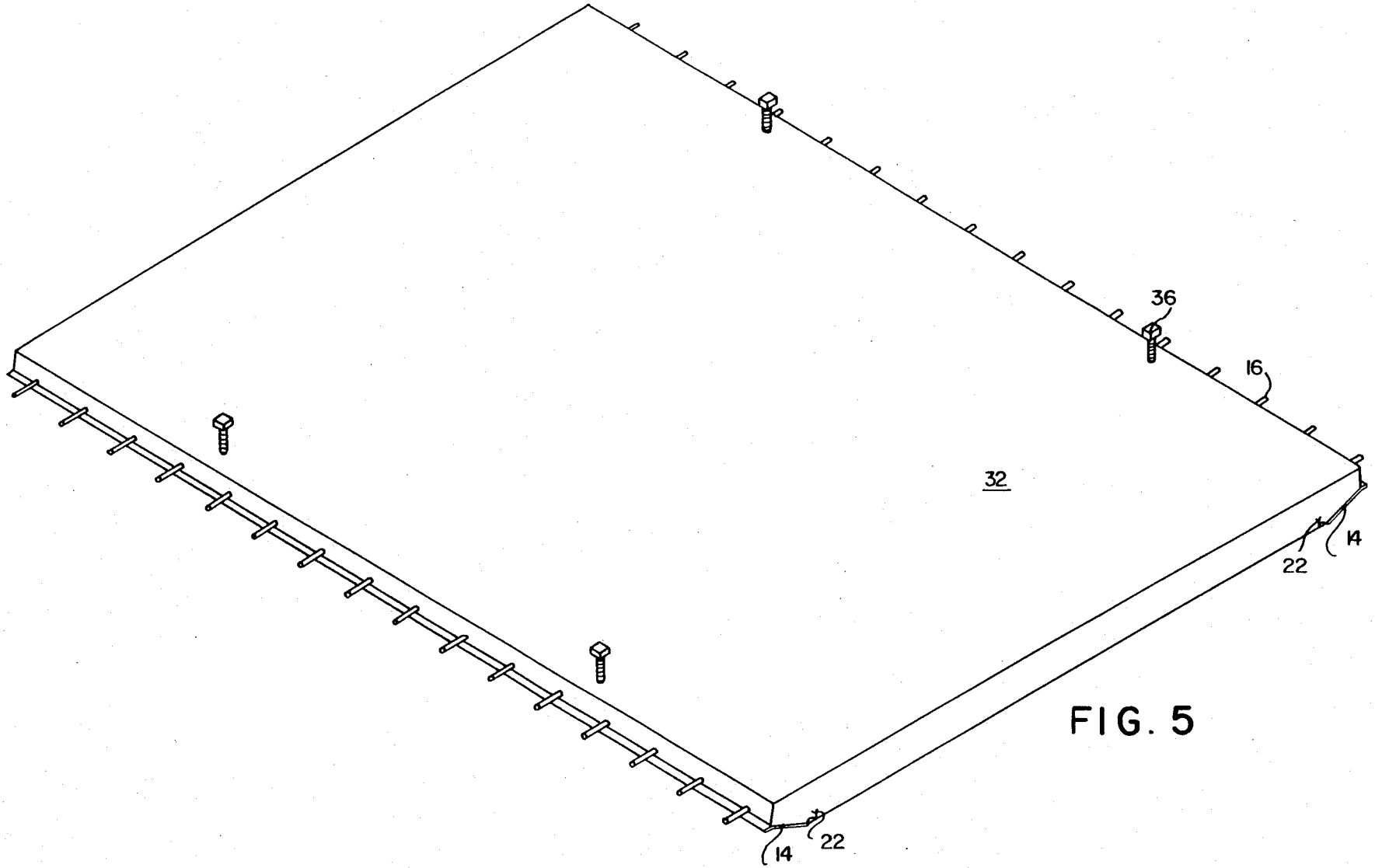
FIG. 5 is an isometric view of the entire panel of FIG. 4A.

A panel 32 illustrated in FIG. 4A is similar to the panel 10 of FIG. 4. The panel 32 has grout seal strips 14 anchored therein with an anchor 22; a thread former 12 with a fixture 18 embedded therein; and a steel strand 16 running therethrough. The panel 32 is shown in FIG. 5 above a support beam 34. A bolt 36 threadedly extending through the thread former 12 projects beyond the panel 32 to provide a desired separation distance between the beam 34 and the bottom of the panel 32. The resilient grout seal strip 14 is made of a relatively stiff material so that, when unstressed, its elongate portions are in general alignment with one another, whereby the upper face of the strip provides part of a form for the bottom of the panel. As shown in FIG. 4A, it has been bent back about the hinge 26 and, due to its springiness and resiliency, the upper face of the inner elongate portion is urged against and slidable over the side edge of the beam 34. As shown, it provides a greater volume between the panel 32 and the beam 34 than if it were horizontal. The sloped portion 38 also makes it easier to introduce grout or concrete into the area between the panel 32 and the beam 34. The grout seal strip 14 is urged against the beam 34 with sufficient force to hold grout or concrete in the area between the panel 32 and the beam 34 and to provide a seal so that grout or concrete does not escape past the strip 14.

Figure 6:
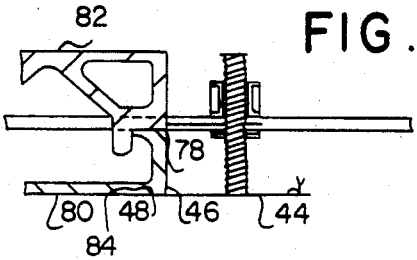
FIG. 6 is a side cross-sectional view of a portion of a bulkhead form, a thread former and a seal strip constructed in accordance with another embodiment of the present invention and prior to casting of a panel.
Figure 6A:
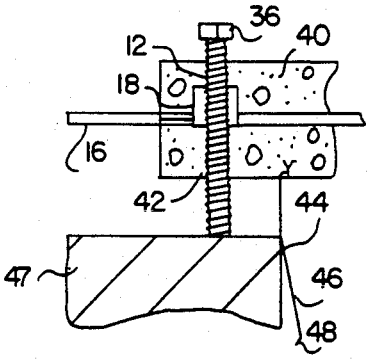
FIG. 6A is a side cross-sectional view of an end of a panel having the seal strip of FIG. 6 cast therein and mounted atop a support beam with the seal strip and a bolt in the thread former in the positions shown in FIG. 5A.

A panel 40 shown in FIG. 6A is similar to the panels 10 and 32, but it has a substantially horizontal bottom surface 42 and substantially straight grout seal strip 44. The thread former 12 of panel 40, bolt 36, fixture 18 and steel strand 16 are like these items in the panels 10 and 32. The inner elongate portion of the grout seal strip 44 has a tab 46 and an angled end 48 for facilitating fabrication of the panel 40 (as will be described in more detail below). The grout seal strip 44 sealingly closes off the area between the panel 40 and a beam 47. The bolt 36 maintains the panel 40 and beam 47 in a desired spaced-apart relation.

Figure 7:
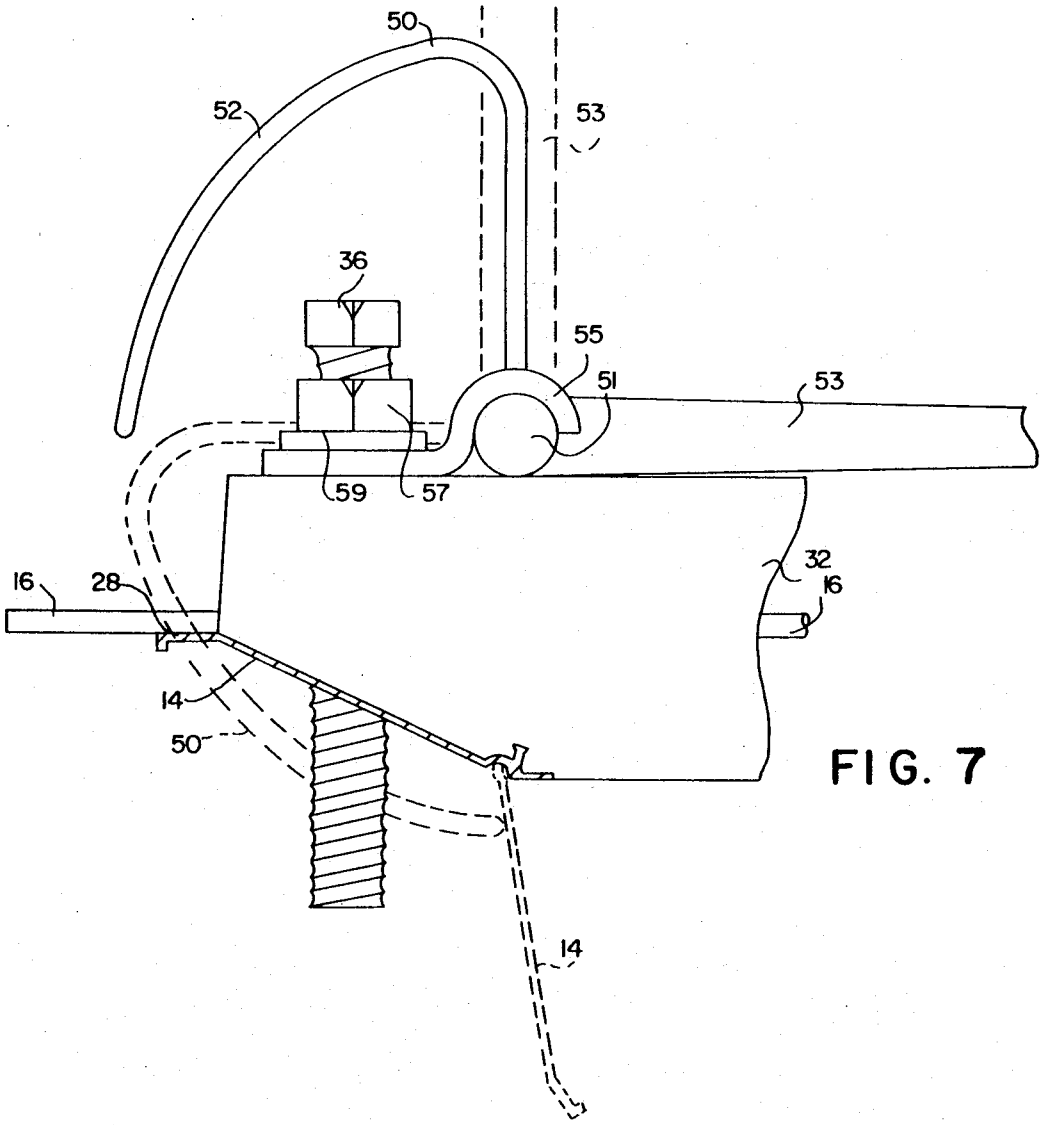
FIG. 7 is a side cross-sectional view of a panel and seal depressor according to the present invention.
Figure 8:
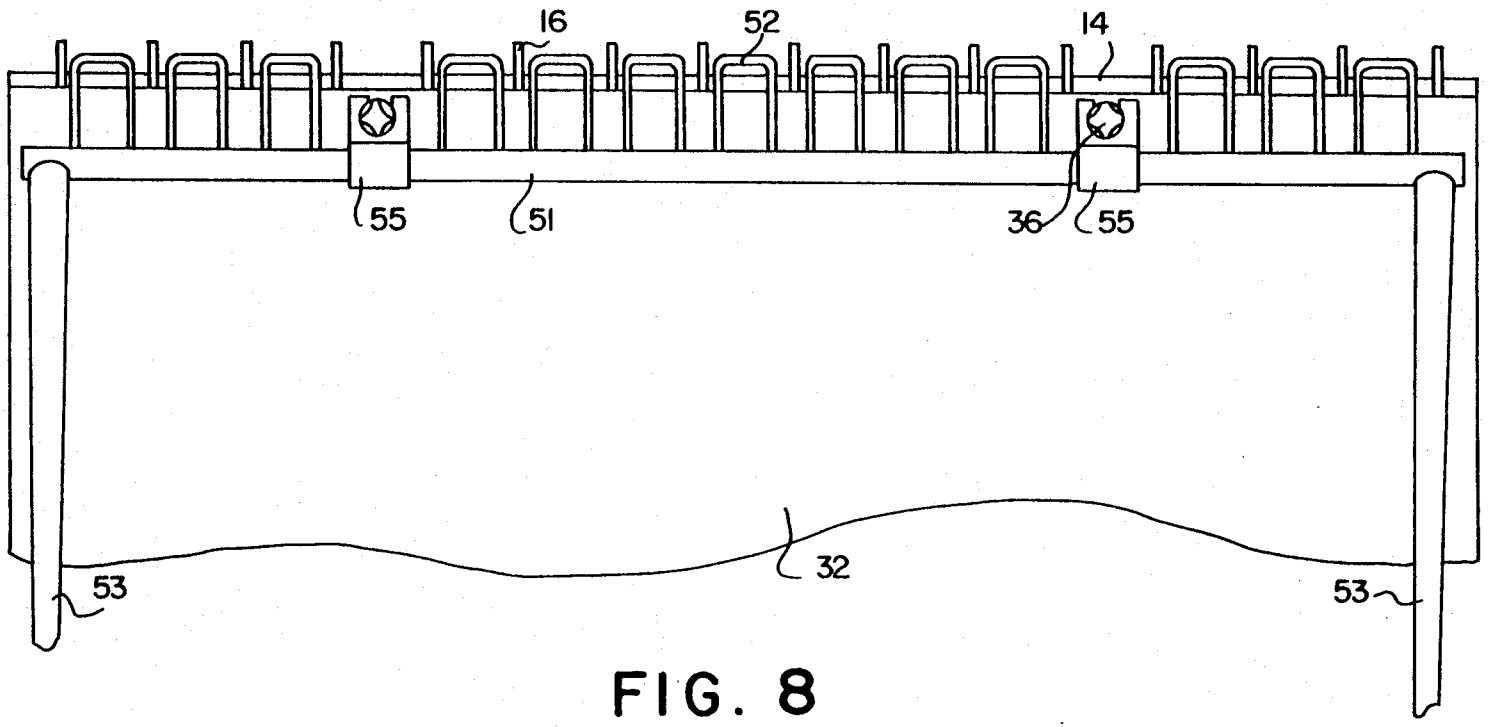
FIG. 8 is a top view of the seal depressor of FIG. 7.

A seal strip depressor 50 is shown in FIG. 7 for moving the grout seal strip 14 of the panel 32. The dotted line drawing of the depressor 50 shows it in engagement with the strip 14. A tine loop 52 of the depressor 50 moves so as to avoid contact with a steel strand 16, yet so that it will contact the end 28 of the inner elongate portion of the strip 14 and move the strip 14 out of the way of a support over which the panel 32 is to be installed. FIG. 8 shows a top view of the items of FIG. 7, including the grout seal depressor 50 with a plurality of tine loops 52 connected to the shaft 51 and two operator handles 53 also connected to the shaft 51. As shown in FIGS. 7 and 8, hinge retainers 55 are used to hold the shaft 51 of the depressor in place. The hinge retainers 55 have a slot or hole through which the bolts 36 pass. The hinge retainers are held in place with a running nut 57 and a washer 59.

Figure 11:
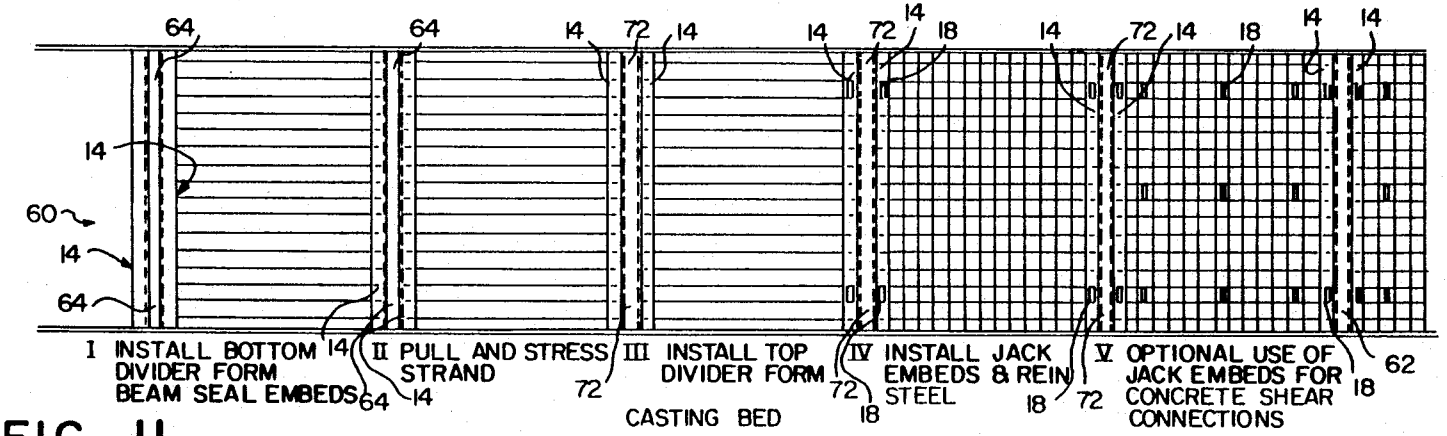
FIG. 11 is a schematic top plan view of a casting bed with bulkhead forms, thread formers, and grout seal strips according to the present invention.
Figure 12:
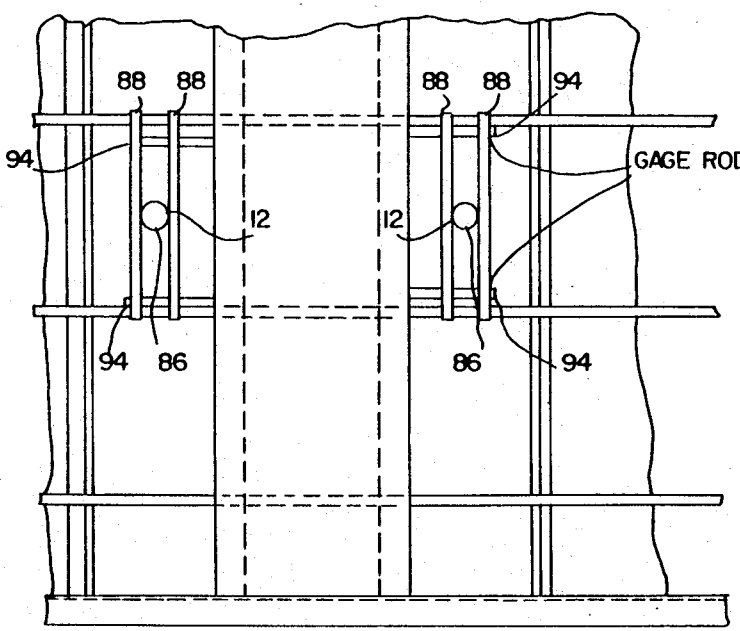
FIG. 12 is a top plan view of a portion of the casting bed showing the details of employment of a thread former according to the present invention.

A casting bed 60 according to the present invention is shown in FIG. 11. Panels such as panels 10, 32, and 40 are fabricated in a casting bed such as the casting bed 60. Bulkheads are positioned across the width of the bed; steel strands and various fixtures are positioned within the bed; and then concrete is introduced into the bed to cover the steel strands. Upon hardening, concrete panels are formed which can be removed from the bed and used as panels for forming decks, floors, etc.

Figure 9:
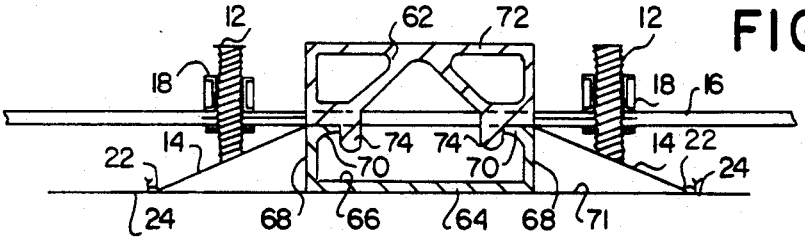
FIG. 9 is a side cross-sectional view of a bulkhead form, grout seal strip and thread former prior to casting the panel of FIG. 4A.
Figure 10:
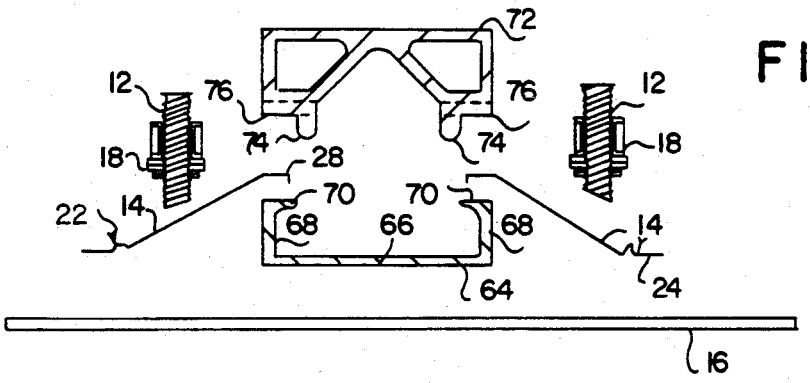
FIG. 10 is an exploded view of the items of FIG. 9.

FIGS. 9 and 10 illustrate various components and fixtures used to make a panel such as the panels 10 and 32. A two-piece bulkhead 62 is used. A bottom piece 64 is first placed in the casting bed 60 across its width. The bottom piece 64 has a bottom member 66, two sides 68, each side 68 having an in-turned lip 70. Next grout seal strips 14 are placed in the bed with the L-shaped end emplaced over the lips 70 of the bottom piece 64. The end 24 of the strips 14 rests on the floor 72 of the casting bed 60. Then a steel strand 16 is placed on top of the piece 64. The top piece 72 of the bulkhead 62 is emplaced above the bottom piece 64. Recesses in the top piece 72 (see dotted lines) receive and hold the steel strands 16. The top piece 72 has two downwardly depending legs 74 which are securingly received in the space between the in-turned lips 70 of the bottom piece 64 of the bulkhead 62. Shoulders 76 of the top piece 72 press against the surface of the strips 14 and assist in holding the strips in place during the operation. Thread formers 12 with securement fixtures 18 are disposed in the casting bed with the securement fixtures 18 firmly attached to steel strands such as the strand 16. A cap (not shown in FIG. 9) is added to close-off the top of the thread formers.

The detail of FIG. 6 is similar to that of FIG. 9, but it shows the bulkhead form and grout seal strip for a panel such as panel 40. As shown in FIG. 6, the bulkhead form 78 has a bottom piece 80 and a top piece 82. The bottom piece 80 has an indentation 84 for receiving an end 48 of a strip 44. A tab 46 of a strip 44 abuts the side of the bottom piece 80 to further secure the strip 44 in place during the operation.

Figure 16:
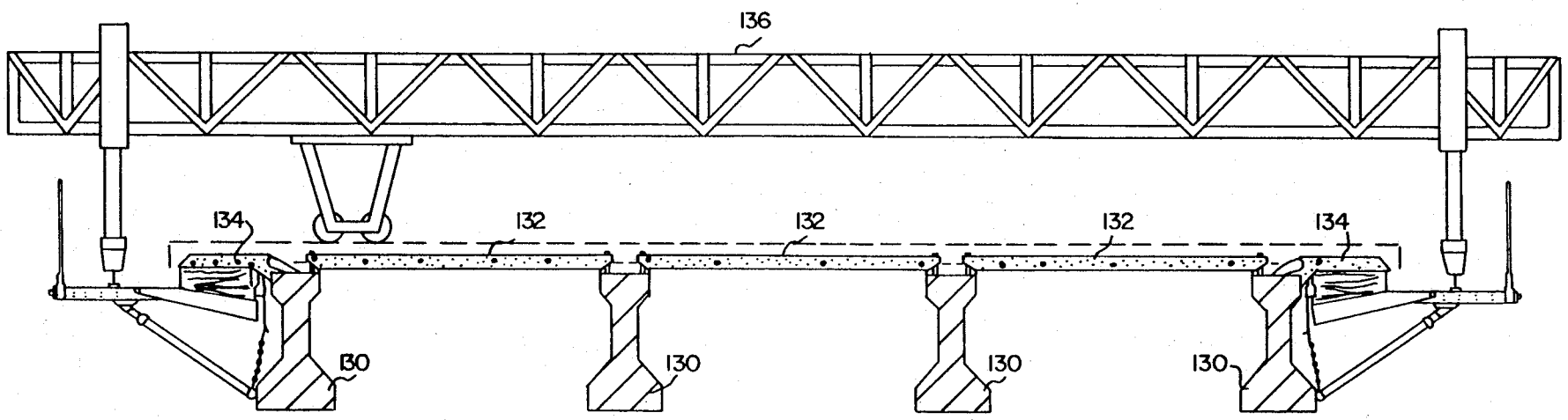
FIG. 16 is a side view partially in cross-section of a bridge deck in formation and apparatus for forming it.
Figure 18:
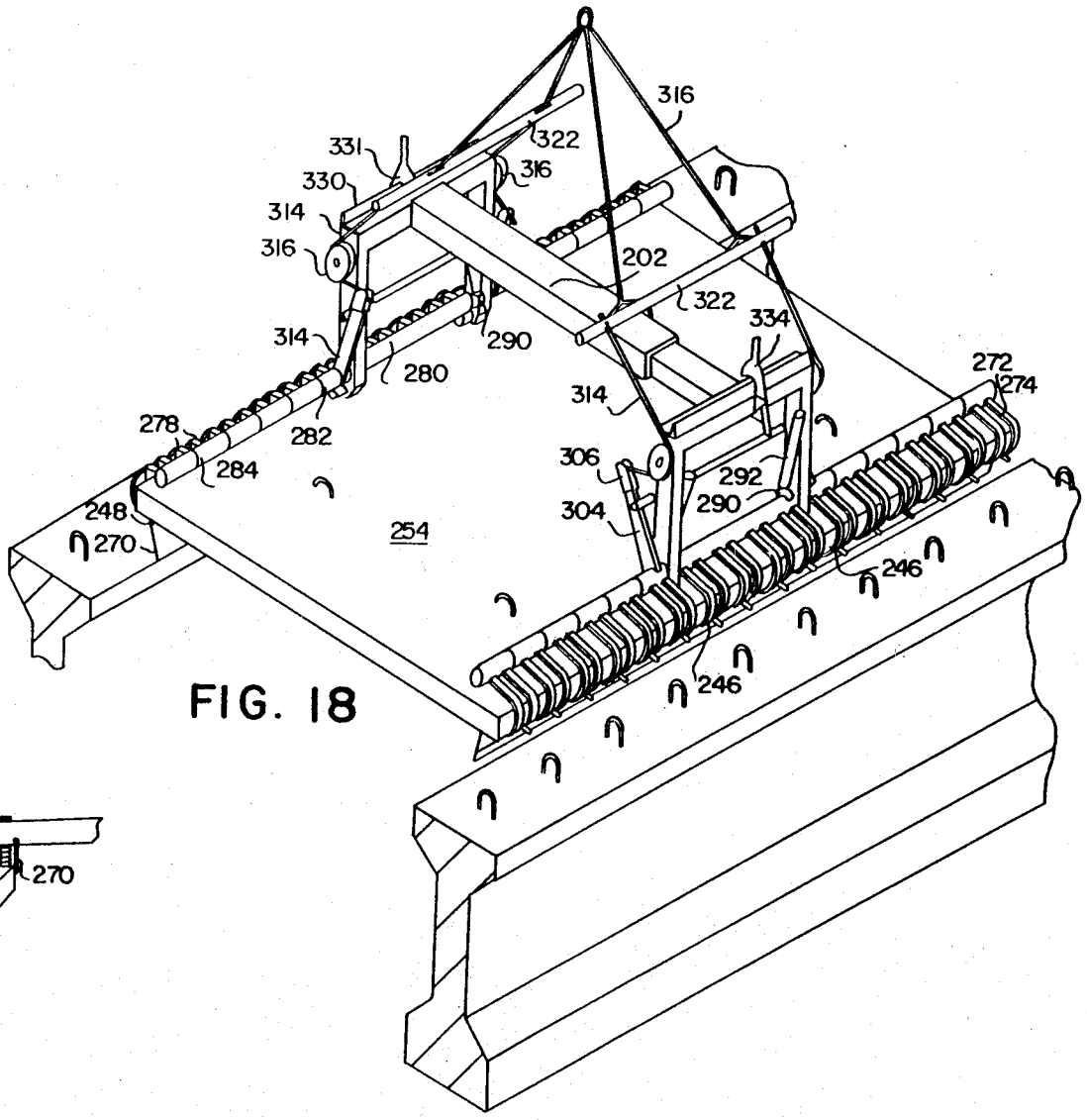
FIG. 18 if a perspective view of the tool as it lowers the panel onto the beams and showing the seal strips rotated into depressed positions for passing between the inner edged of the beams.

FIG. 16 illustrates the use of a thread former 12 in the fabrication of a panel according to the present invention such as panel 10. A thread former 12 has a central tubular member 86 made of sheet steel tube to which are secured two arms 88 made of sheet steel. Each arm 88 has a semicircular finger and an L-shaped, bendable crimpable finger. The fingers provide means for securing their respective arms to steel strands 16 within a casting bed. The semicircular finger is wrapped around a steel strand and the arm is laid on an adjacent strand.

The crimpable finger is then bent or crimped around the adjacent strand. The thread former 12 is emplaced near a bulkhead form so that gage rods 94 disposed under and secured to the arms 88 are in contact with the bulkhead form, insuring proper positioning of the thread formers. The tubular member 86 can be connected to the arms 88 by resistance welding or brazing. Gage rods 94 are similarly connected to the arms 88.

An alternative, a thread former has a central tubular threaded member about which is secured a securement fixture. The fixture has a central hollow cylindrical member which is disposed about the tubular member and a plurality of arms 148 extending outwardly for connection to steel strands 16. Each arm 148 has a semicircular grip ring 150 at its end for emplacement about a strand 16. It is within the scope of this invention to use one or more such arms. When using two or more opposed arms the thread former will support itself on strands 16. The thread former can be an integral molded unitary piece or the tubular member can be a piece separate from the fixture. The fixture can be secured to the tubular member such as by welding or gluing or it can simply be emplaced about the tubular member with no further connection. The tubular member and fixture can be formed of plastic, metal, wood or any other suitable material.

Figure 15:
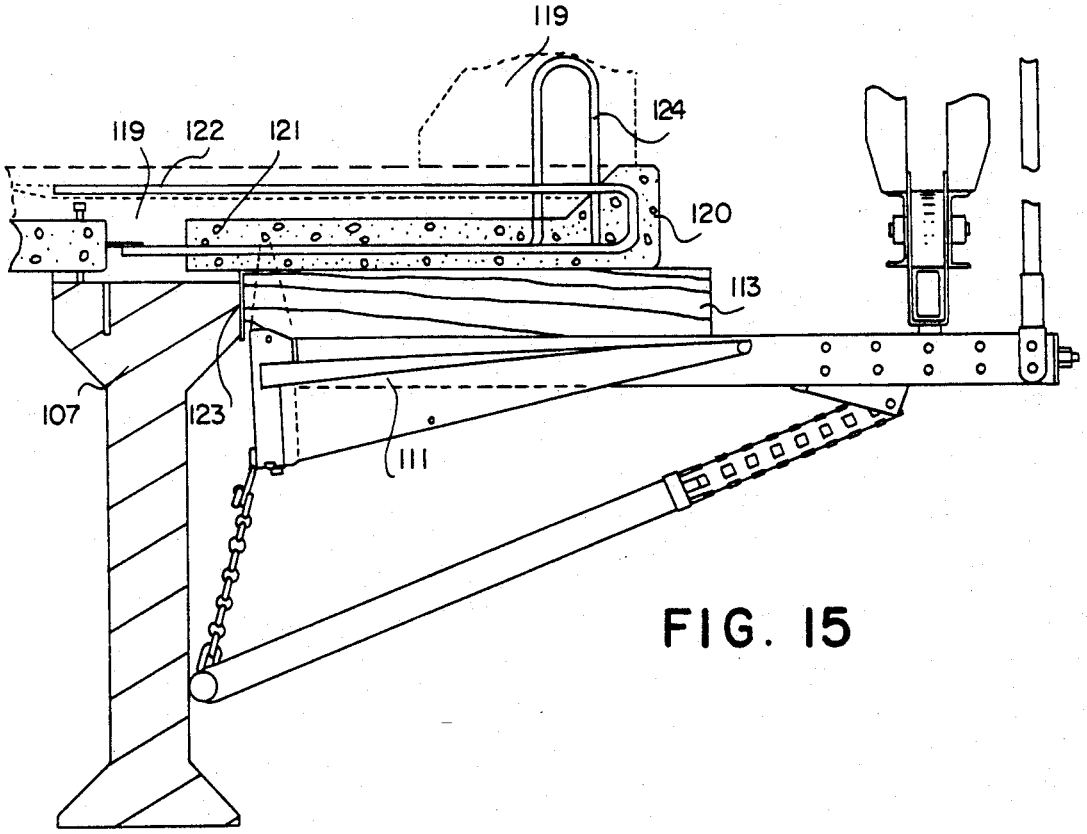
FIG. 15 is a side cross-sectional view showing the use of the overhang panel of FIG. 14.

In the casting bed procedure illustrated in FIG. 15. Step I is the installation of the bottom piece of a two-piece bulkhead form and the emplacement of grout seal strips in the bed. Step III is the installation of the top piece of a two-piece bulkhead form and Step IV is the installation of the thread formers ("jack embeds"). "Rein Steel" is the reinforcing steel used to resist internal stresses transverse to the prestressing strands.

In Step II lengthwise steel strands are disposed in the casting bed over the bottom pieces of the two-piece bulkhead forms. The steel strands are then anchored and stressed in a conventional prior art manner. In step V concrete shear connectors and thread former ("jack embeds") are installed (as is described in more detail below). Finally, concrete is introduced into the bed to form the panels.

The shear connector has a threaded central member and an upwardly extending figure-eight multiple loop member. The shear connector is preferably made from steel to provide maximum shear strength.

To permit emplacement of the shear connectors in a panel, shear connector thread formers are secured in the casting bed 60 (see discussion of Step V, above). The shear connector thread formers are similar to the thread former 12 and are used with securement fixtures, but without gage rods. The figure-eight loop configuration is helpful because it anchors into a relatively large amount of cast-in-place concrete.

Figure 13:
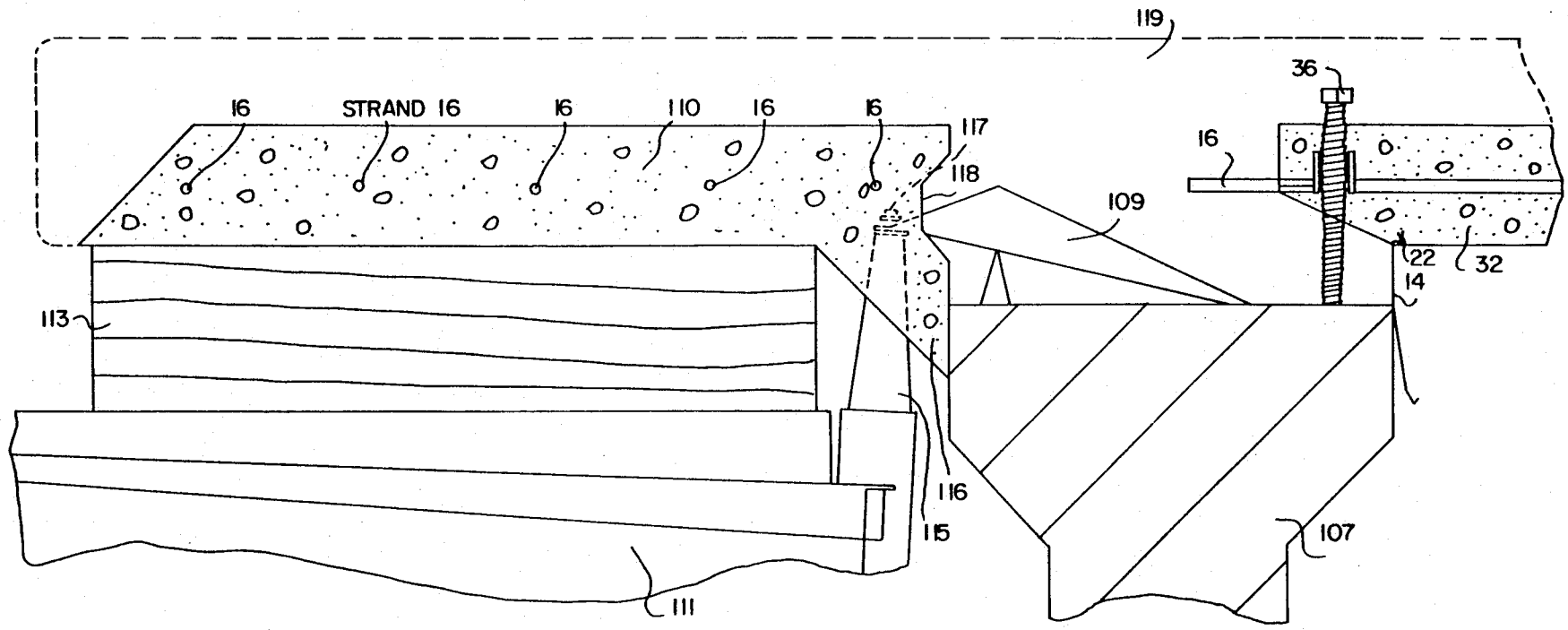
FIG. 13 is a side cross-sectional view showing the use of an overhang panel.
Figure 14:
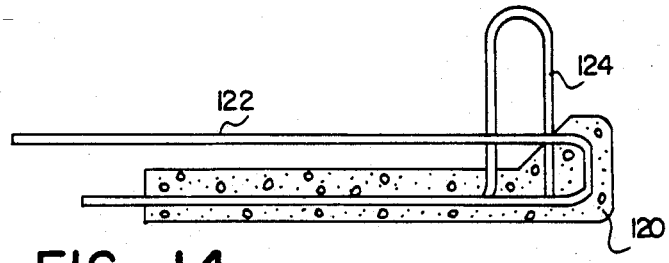
FIG. 14 is a side cross-sectional view of an overhang panel according to the present invention.
Figure 22:
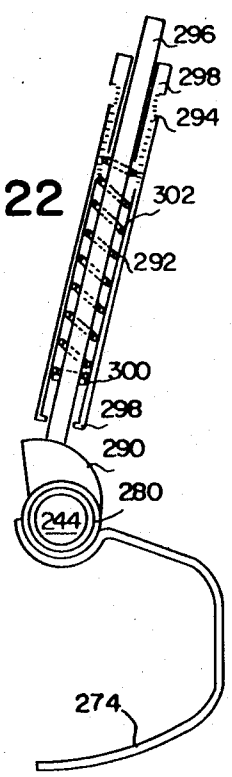
FIG. 22 is an enlarged, detailed sectional view of the depressor in seal strip depressing position and showing a device which urges it to releasing position.
Figure 23A:
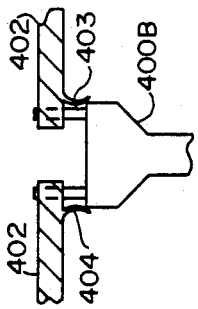
FIG. 23A is a cross-sectional view, as seen along broken lines A—A of FIG. 23, of one of the support beams and the sides of a pair of decking panels supported above the sides of the beam by means of bolts imbedded in the beams and showing seal strips on the decking panels engaged with the side edges of the beam in order to contain grout between the bottoms of the panels and tops of the support beams, as shown, for example, in the embodiments of the invention shown in FIGS. 6A and 7A.
Figure 23B:
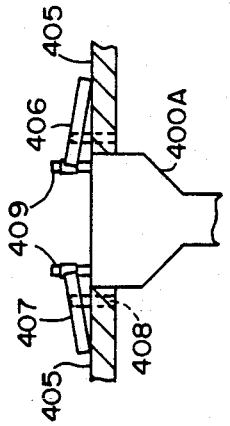
FIG. 23B is another cross-sectional view, as shown along broken lines B—B of FIG. 23, showing a support beam with a pair of forming panels having their side edges disposed closely within the sides of the beam and supported therefrom by means of hangers constructed in accordance with the present invention.
Figure 23:
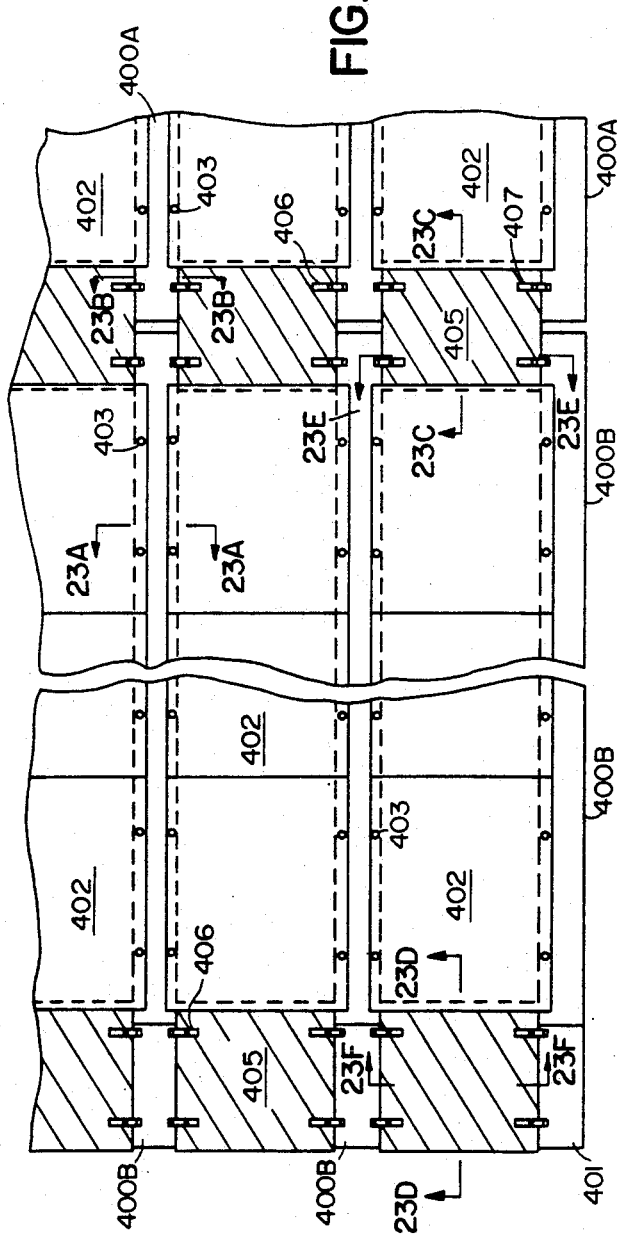
FIG. 23 is a top plan view of longitudinally extending, laterally spaced apart rows of support beams having decking panels supported thereon and spanning between the beams of adjacent rows and forming panels supported by hangers along their opposite longitudinal sides to dispose their side edges closely between the opposite sides of the spaced beams and their laterally extending ends beneath the overhanging, laterally extending ends of the decking panels near the ends of the beams intermediate the ends as well as adjacent the end of the bridge span.
Figure 25:
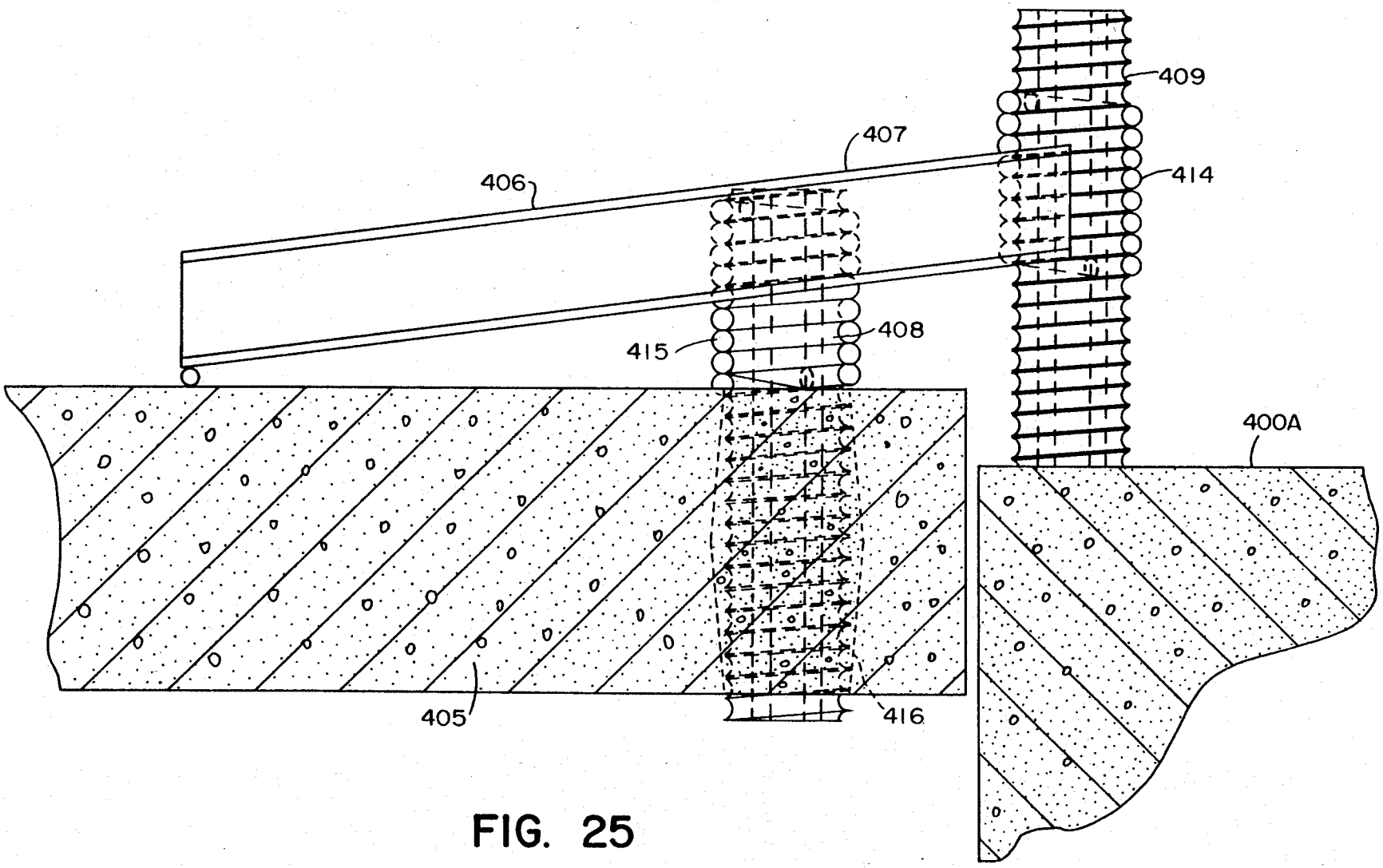
FIG. 25 is an enlarged cross-sectional view of adjacent sides of a support beam and forming panel, as in FIG. 23B, but showing details of the hanger which supports the forming panel from the beam.
Figure 25B:
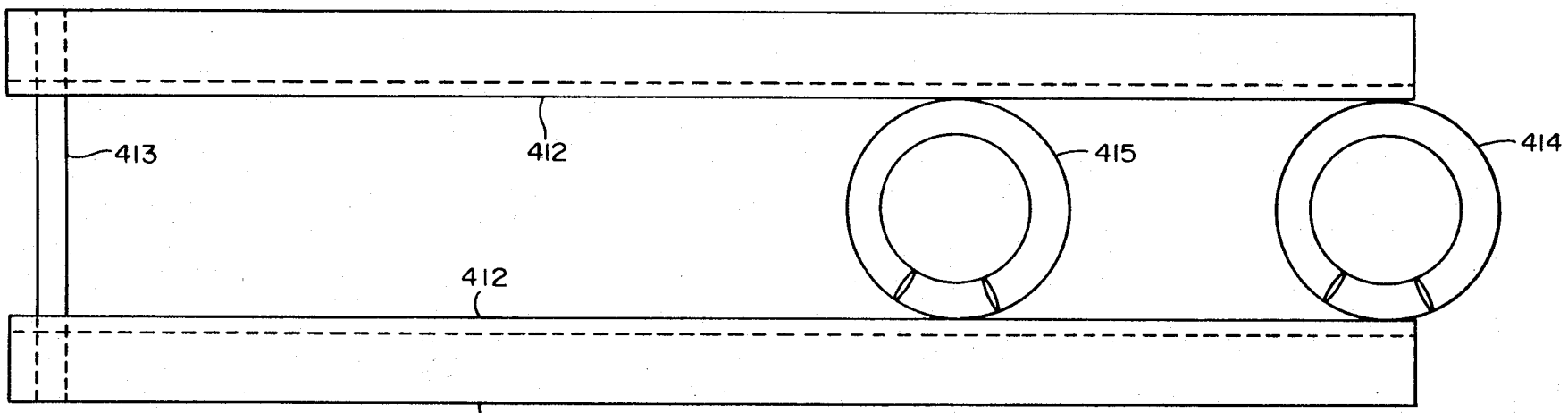
FIG. 25B is a top plan view of the beam of FIG. 25A and showing the laterally spaced apart channels mounted on opposite sides of the thread formers.
Figure 25A:
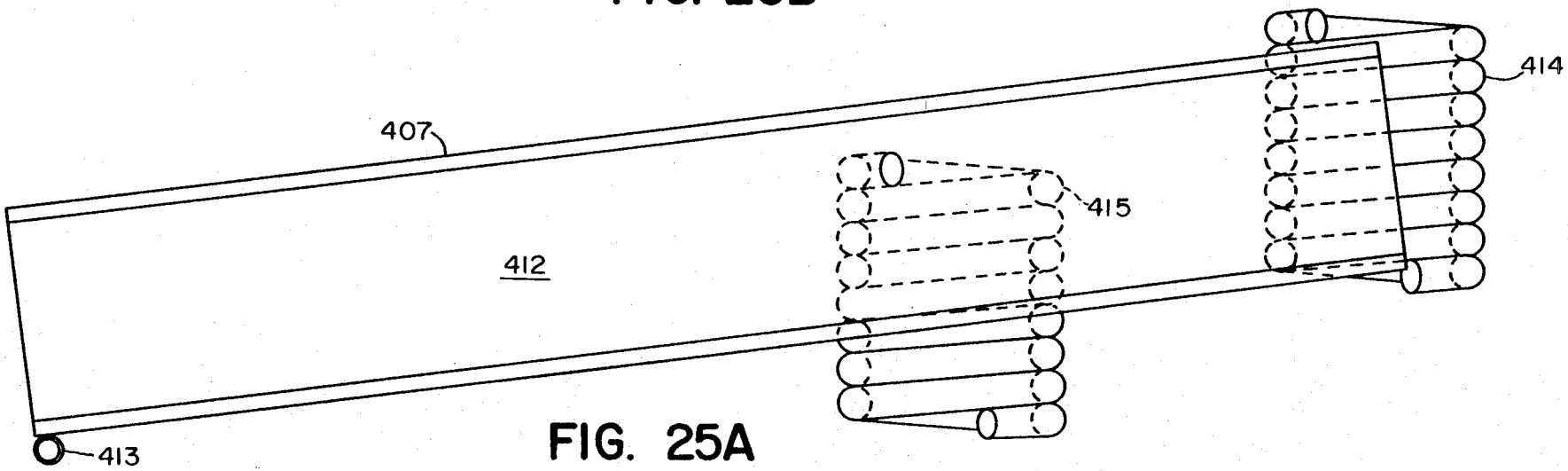
FIG. 25A is a side view of the beam of the hanger of FIG. 25, including thread formers shown in broken lines for receiving bolts for connecting the beam to the forming panel in a position to support the forming panel from an adjacent side of the support beam.
Figure 26:
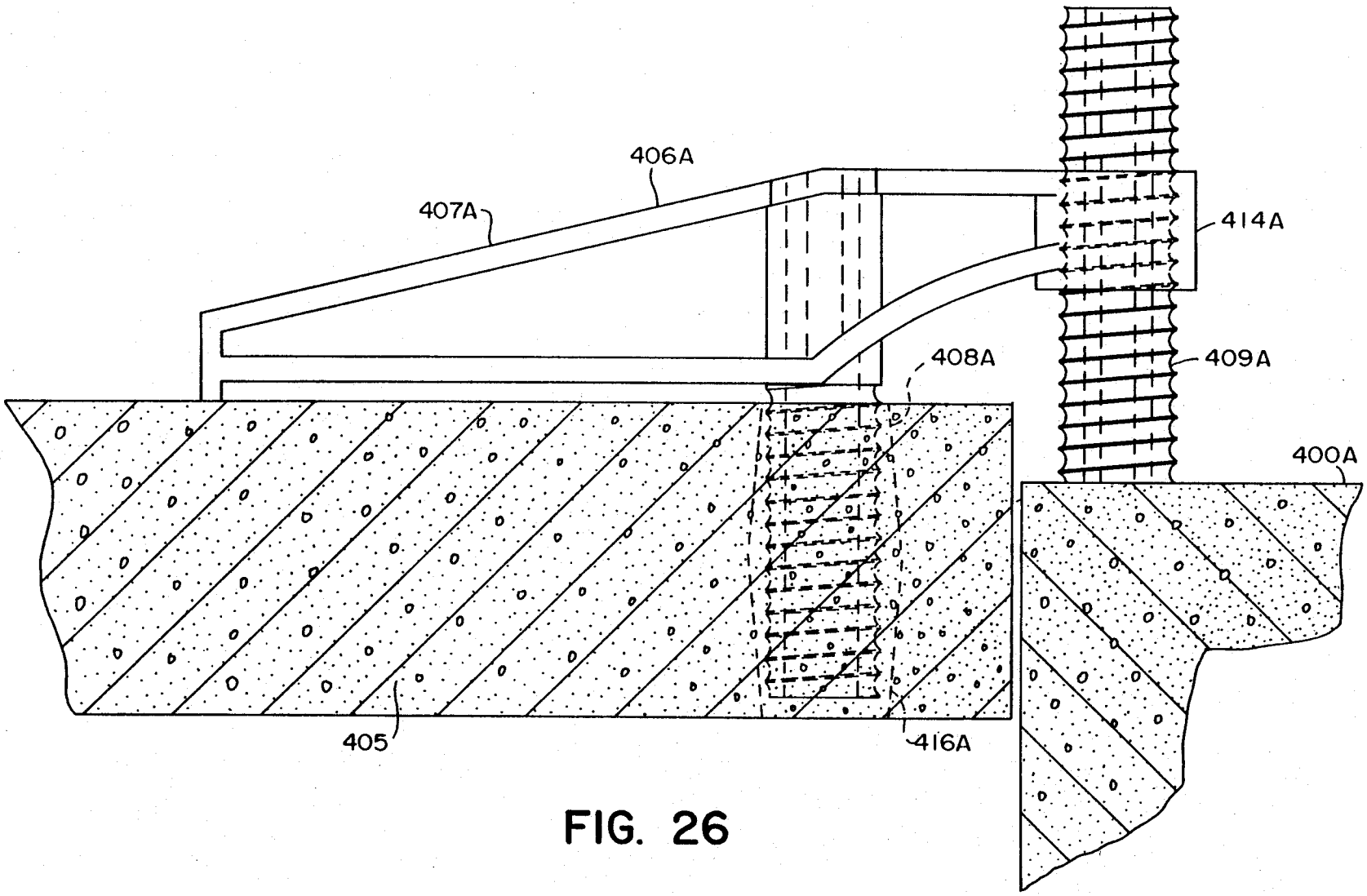
FIG. 26 is an enlarged cross-sectional view of adjacent longitudinal sides of a support beam and forming panel, as in FIG. 23B, but showing an alternative form of hanger, having an integral or one-piece cast plastic body in which the thread formers are mounted.
Figures 26A, 26B:
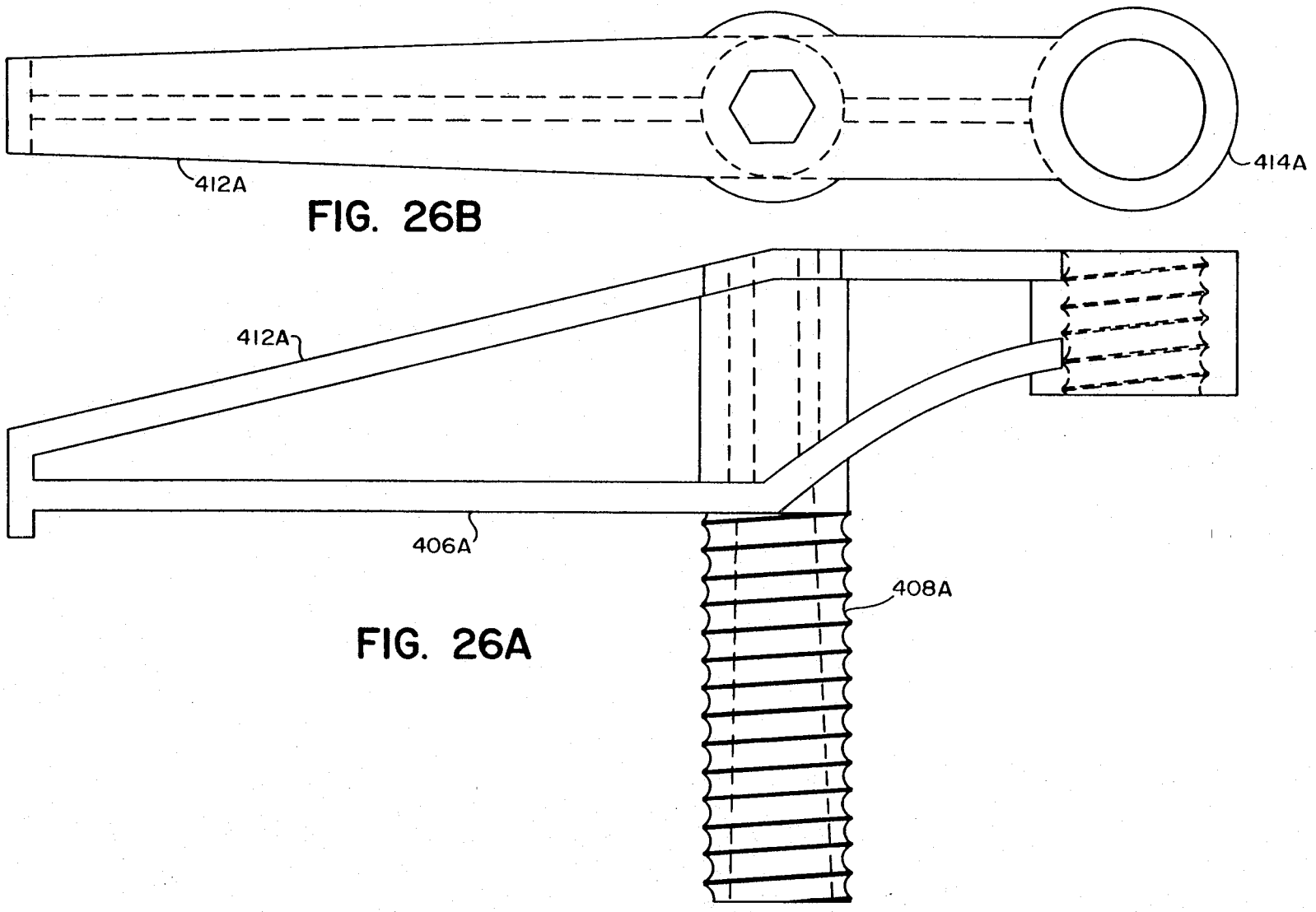
FIG. 26A is a side view of the body of the hanger of FIG. 26, with the bolts removed from the thread formers thereof.
FIG. 26B is a top view of the body of the hanger of FIG. 26A.
Figure 26C:
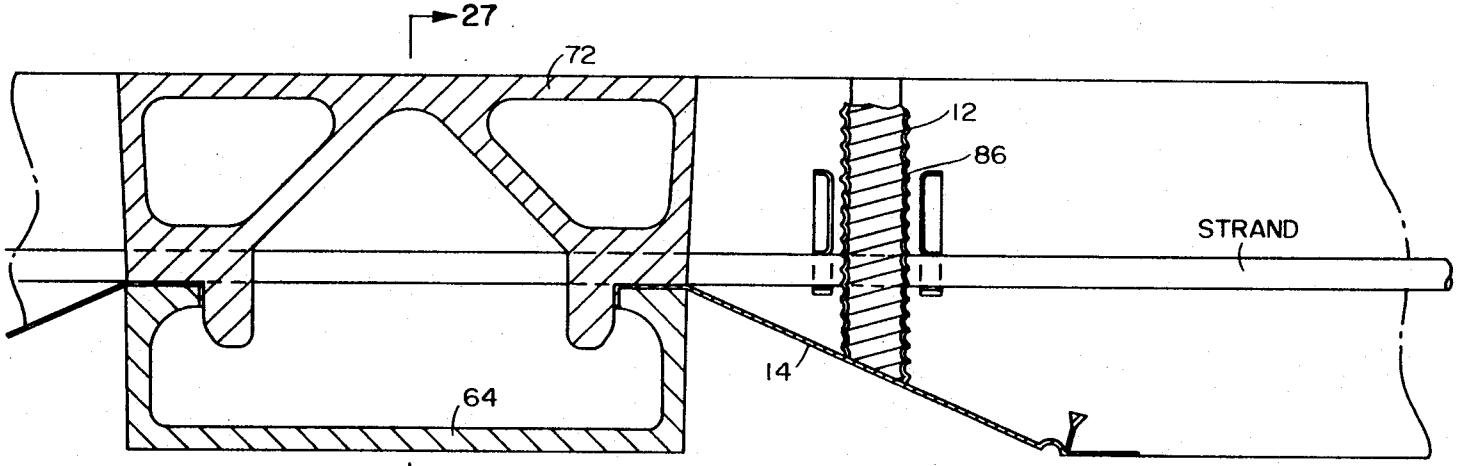
FIG. 26C is an enlarged side cross-sectional of a bulkhead, grout seal strip, thread former and end of a panel, as shown in FIG. 9 as seen along line A—A of FIG. 27.
Figure 27:
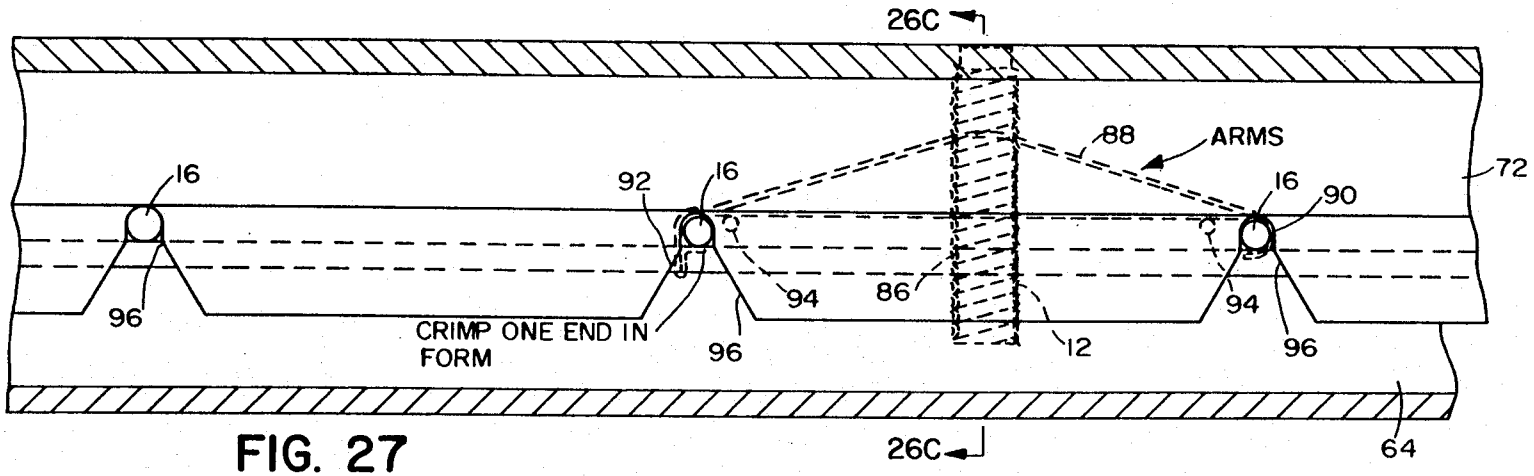
FIG. 27 is a cross-sectional view of the apparatus of FIG. 26C along line B—B of FIG. 26C.
Figure 28A:
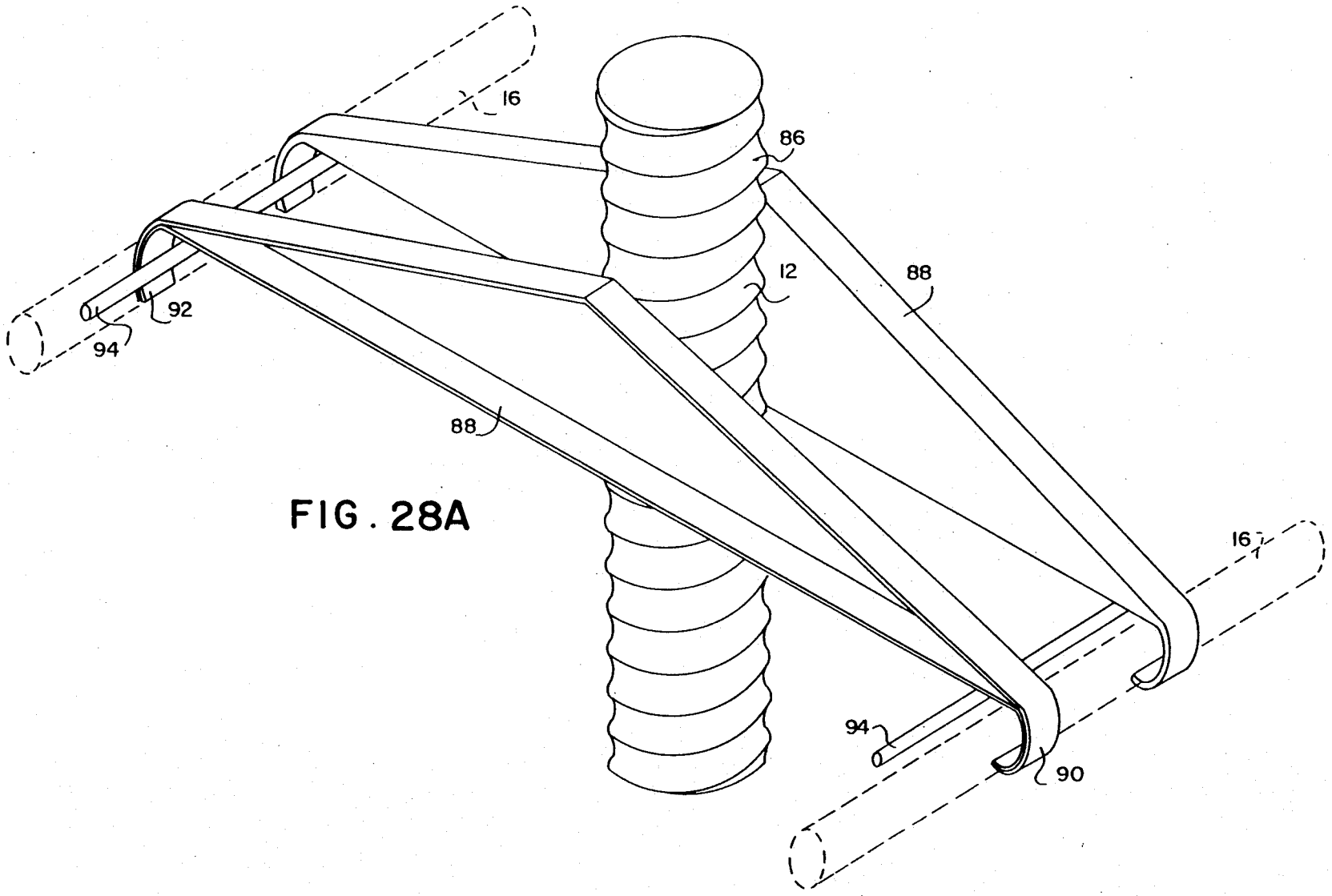
FIG. 28A is an isometric view of the thread former device of FIG. 26C.
Figure 28B:
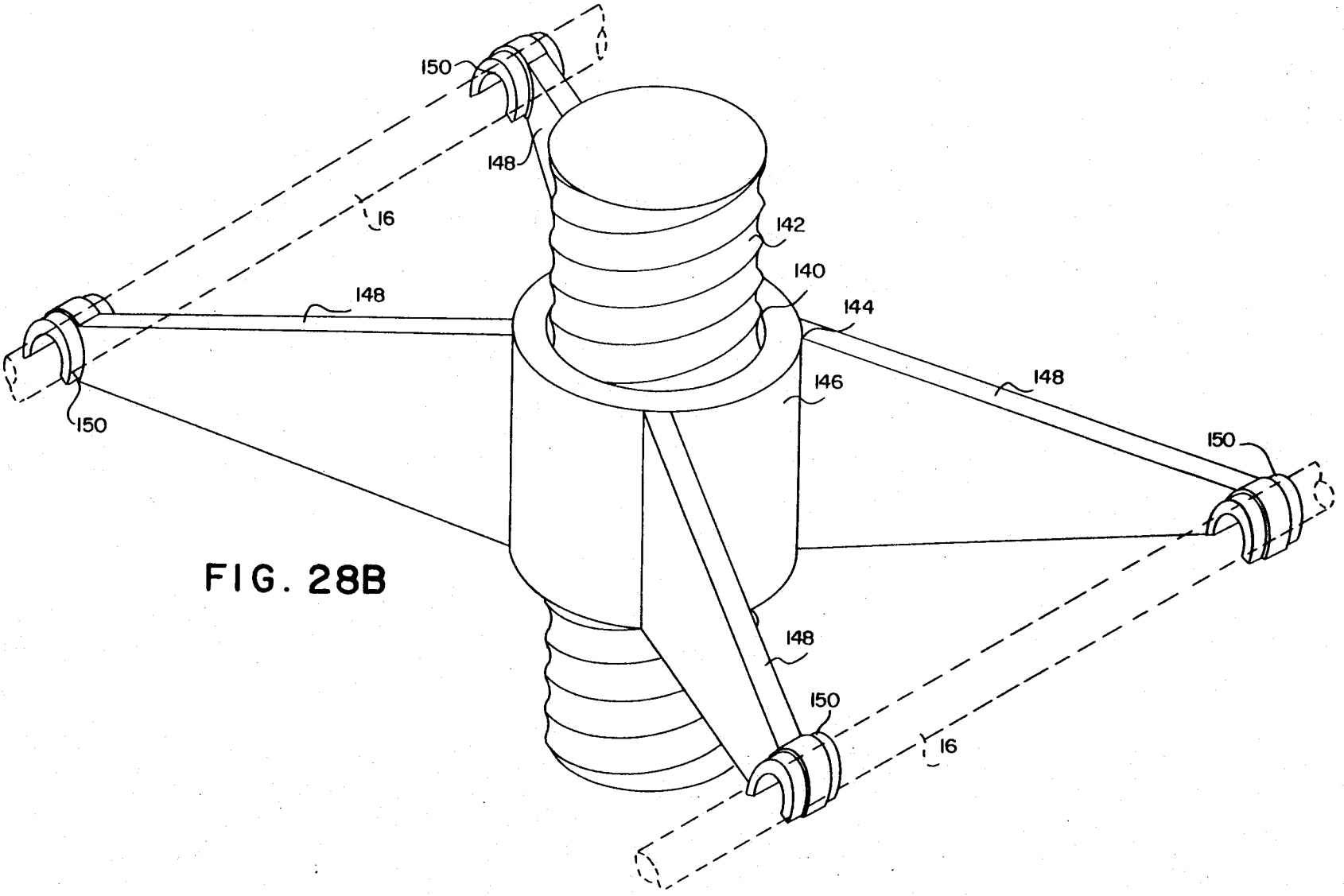
FIG. 28B is an isometric view of a thread former according to the present invention.
Figure 29:
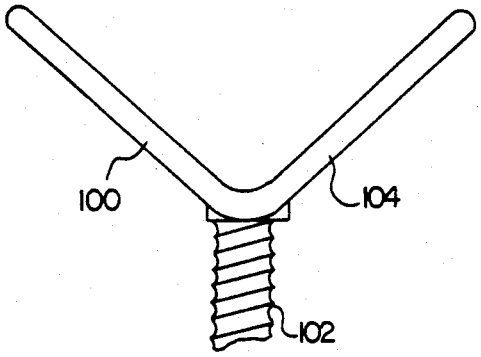
FIG. 29 is a side cross-sectional view of a shear connector according to the present invention.
Figure 30:
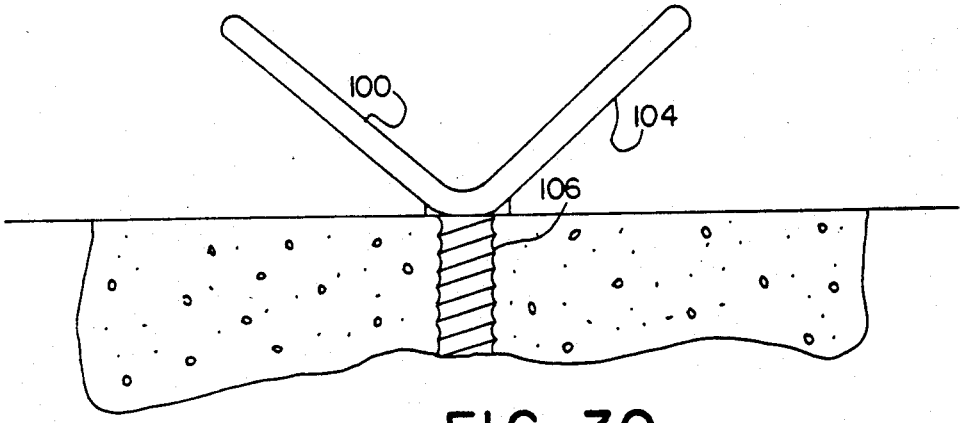
FIG. 30 is a side cross-sectional view of part of a panel and a shear connector according to the present invention.
Figure 31:
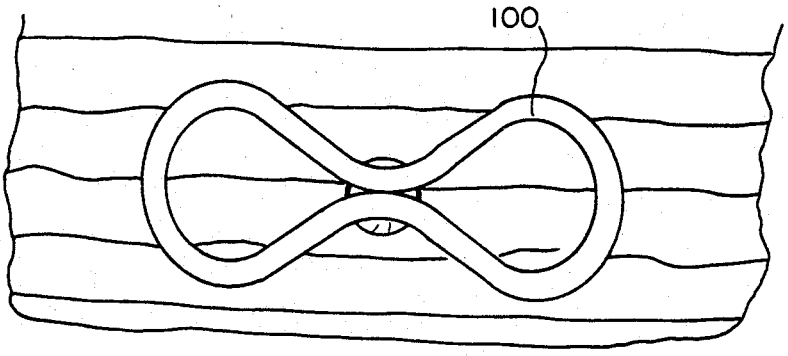
FIG. 31 is a top plan view of the apparatus of FIG. 30.
Figure 32:
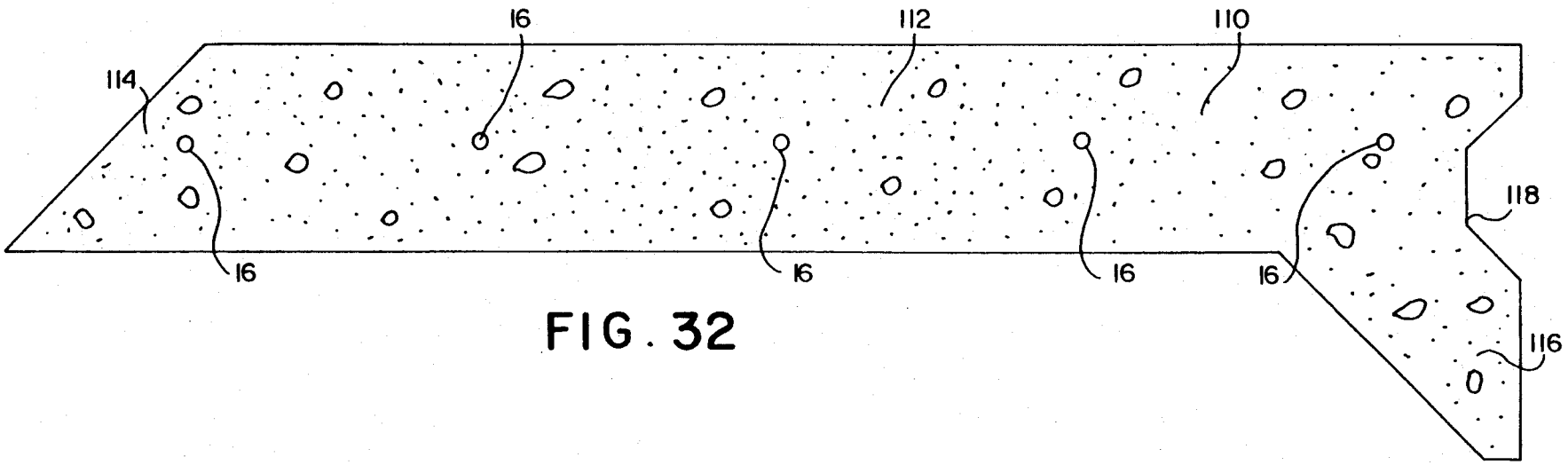
FIG. 32 is a side cross-sectional view of an overhang panel according to the present invention and FIG. 33 is atop view of the panel.

FIGS. 22, 23 and 25 relate to the overhanging portion of a deck and to overhang panels. As shown in FIG. 22 an overhang panel 110 has a main body with strands 16 therethrough, an outwardly extending sloping side member, downwardly extending bottom member 116, and an inner keyway 118. An overhang panel is employed, for example, on the outermost structural support beam of a bridge deck. As shown in FIG. 13, the panel 110 is set on wood blocking 113 with downwardly extending bottom member 116 against the side of a beam 107. Wood blocking 113 is supported by an overhang bracket 111 (as shown in FIG. 15). The overhang bracket 111 is suspended from the beam 107 by the use of a steel hanger 109 which will be encased in cast-in-place reinforced concrete 119. An upward extension arm 115 of the overhang bracket 111 is secured to hanger 109 by a nut 117 which also will be encased in the reinforced concrete, while the bolt fastened thereto and upward extension 115 will be withdrawn after the reinforced concrete 119 has cured. The overhang bracket 111 provides adjustability to set the panel 110 to predetermined grade while the downwardly extending bottom member 116 provides the containment seal to prevent the loss of reinforced concrete 119. After the reinforced concrete 119 has cured, the panel 110 acts as a composite unit with it, gaining vertical support through inner keyway 118 and horizontal support from the reinforced concrete 119 cast over and bonded to it.

FIGS. 23 and 25 illustrate another embodiment of an overhang panel 120 according to the present invention. The panel 120 has reinforcing steel bars 122 and 124 partially embedded therein. These steel bars will become part of a deck once covered with concrete. Foam 121 can be used between panels to allow for contraction and expansion. As shown in FIG. 15, the overhang panel 120 is emplaced on an outermost support beam of a bridge deck. The dotted line in the figure indicates the extent to which concrete 119 is poured over the panel 120 (and other panels) to form the deck. The steel bars 122 and 124 become completely enclosed in concrete 119 and they help to form a strong deck and a strong sidewall. Similar to the support described in FIG. 13, the panel 120 is set on wood blocking 113 with its inward edge 121 overhanging beam 107. Overhang bracket 111 is as described in FIG. 13. Angle 123 is supported by timber blocking 113 and is set against the side of beam 107 to provide the containment seal to prevent the loss of reinforced concrete 119.

FIG. 16 shows a four-beam configuration with four structural support beams 130, three interior panels 132 according to the present invention (similar to panels 10 and 32 described above), and two overhang panels 134 according to the present invention (similar to overhang panel 110 described above). The dotted line above the panels indicates the level to which concrete will be poured above the panels to form the deck. The cantilever overhang panel support is described in my previous U.S. Pat. No. 4,660,800. The system 136 for introducing concrete on the panels is a conventional prior art system.

The tool shown in FIGS. 17 to 22 has a main structural framework 202 made up of two end frames 204 and 206 each made up of two vertical legs 208, spaced apart to center between the outer strand 210 and its adjacent strand 211 at each edge of 2 minimum width panels by being rigidly attached to a cross beam 214 at their top ends. The two end frames 204 and 206 are rigidly attached to a spacer beam 216 made up of two rectangular tubes, one telescoping into the other to permit the length of the spacer beam to be adjusted to different panel widths. That is, the tubes may be moved to and fixed in desired positions by any suitable means.

Panels are cast in an infinite variety of sizes. The space between the beams in a bridge span is variable, so the span dimension of the panels, parallel to the prestressing strands, varies to span between the beams for each bridge span. Bridge span length vary, so the width dimension of the panels, perpendicular to the strands, varies to provide a combination of panel widths to match the needs of each bridge span length. The width of the panels is limited by the width of the casting bed, and the design engineer sets a minimum width. The length of the panel is limited only by its structural strength.

Figure 21:
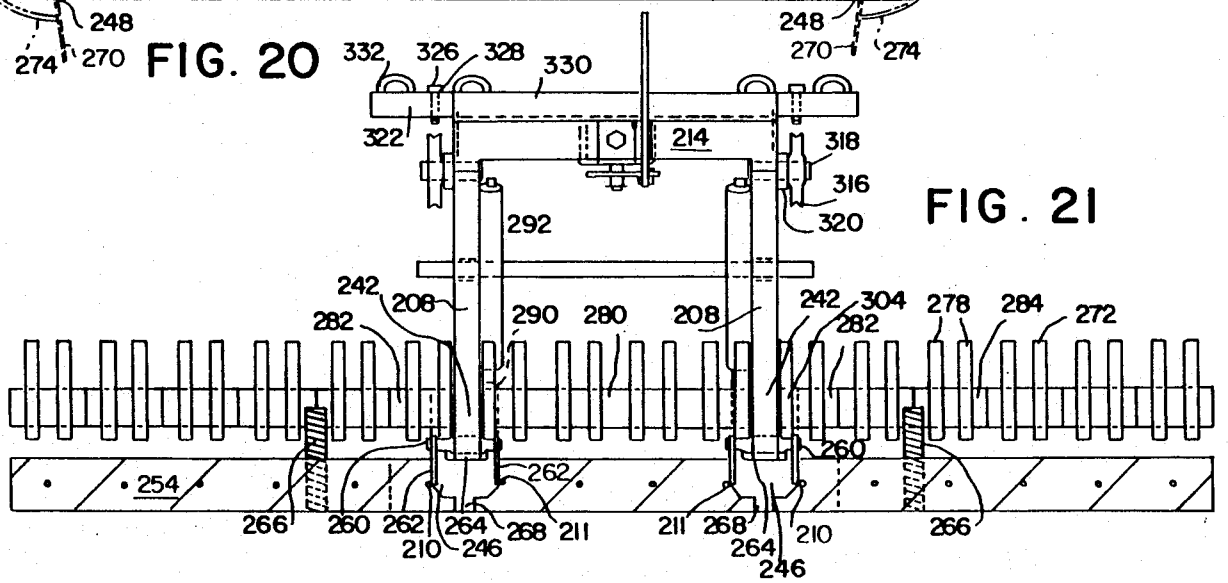
FIG. 21 is a side view of the tool and panel with the tines of the depressor in panel releasing position.

At a point that provides proper clearance above the panel, when the tool is attached thereto, a tube 242 is fixed into each leg 208, aligned to allow the passage of a rotatable shaft 244 through the two legs 208 of each end frame 204 and 206. The rotatable shaft 244 passing through the legs 208 is a round tube equal in length to the maximum width of the panel, and is installed to extend equally from each leg 208. Below the tube, a guide foot 246 is fixed to the legs 208 over the hinge line of seal strips 248 cast into the panel. Each guide foot 245 is an angle with a horizontal leg 250 of a length to position the legs 208, as above, when a vertical downward leg 252 bears against the end 256 of the panel. The length of the angle is equal to the space between the strands in the panel as shown in FIG. 21 and is fixed to the leg 208 with a tubular member 260 reinforced with ribs 262, and has a cutout 264 in the horizontal leg 250 to allow for the passage of a temporary support bolt 266 on the panel if one happens to fall at that location. The vertical leg 252 has an extension 268 bent outward at a 45 degree angle to help guide the frame 202 into proper position relative to the ends of the panel, and shaped at its side edges to help guide the frame 202 to center the legs 208 between two strands 210 and 211 as the tool is lowered onto the panel.

The seal depressor includes a number of depressing tines 272 spaced along each shaft 248. Each tine 272 is a strip of metal formed to a shape so that, in its depressed position 274 (shown in dotted lines in FIG. 20) wraps downward around the end of the panel, and then back under the panel to a point slightly beyond the hinge line 248 of the seal strip 270.

The prestress strands are always uniformly spaced, and the width of any panel is always a multiple of that spacing with a strand centered in each space. Panel temporary support bolts 266 vary in position, depending on the width of the panel but are always positioned on a centerline between two strands. The tines 272 are therefore positioned along the shaft 244 in pairs 278, with tines 272 of each pair 278 spaced apart to allow for clear passage over the protruding strand as they are rotated down to depress the seal strip 270. Each pair 278 is positioned along the shaft 244 at a spacing equal to the strand spacing. The tine pairs 278 are narrow in width so the clear space between them allows clearance for the temporary support bolts 266, both for access to install the bolts from the top at any position of the tines 272, and below the panel where they protrude to support then panel when the tines 272 are in the depressed position 274.

The tines 272 between the legs 208, and the first pair 278 outside of each leg 208, are within the minimum panel width and are therefore needed for handling every pane. They are therefore fixed to pipe spools 280 and 282 that are sized to fit the shaft 244 and are shear pin fixed to the shaft 244. The tines 272 outside the minimum panel width are needed only to the extent of the width of each panel, and any tines 272 beyond the width of that panel would be an obstacle to the placement of the panel against another already in place as required, if they were in the depressed position 274. Each pair of tines 278 outside of the minimum panel width is therefore fixed to a separate pipe spool 284 of a length equal to the strand spacing and provided with a spring loaded shear pin 286 so it can be individually pinned to the shaft 244 in alignment with the fixed tines, or rotated upward and pinned out of the way as shown by broken lines 287 in FIG. 20.

Figure 17:
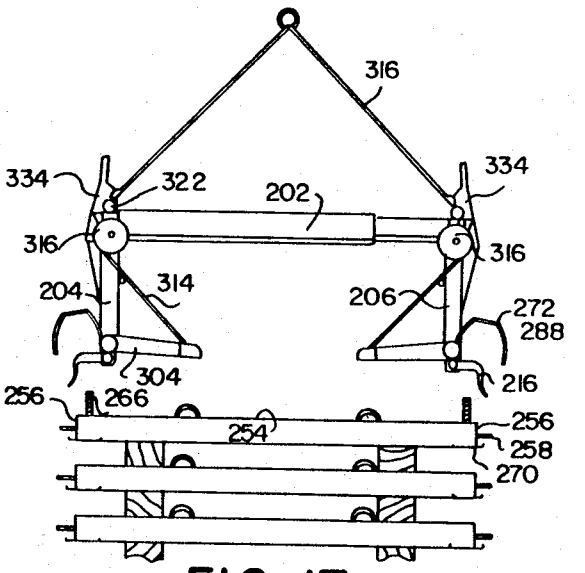
FIG. 17 is an end view of a tool including a seal depressor positioned above a stack of panels prior to lowering onto the top panel for attaching to it and lifting it to a locating for lowering onto laterally spaced beams.
Figure 19:
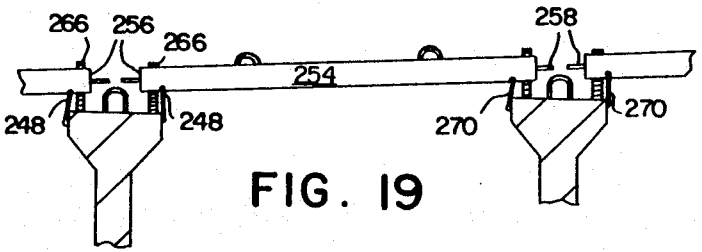
FIG. 19 is a view of the beams with the panels following mounted thereon and upon raising of the tool therefrom and with the seal strips released from the depressor to engage the edges of the beams.
Figure 20:
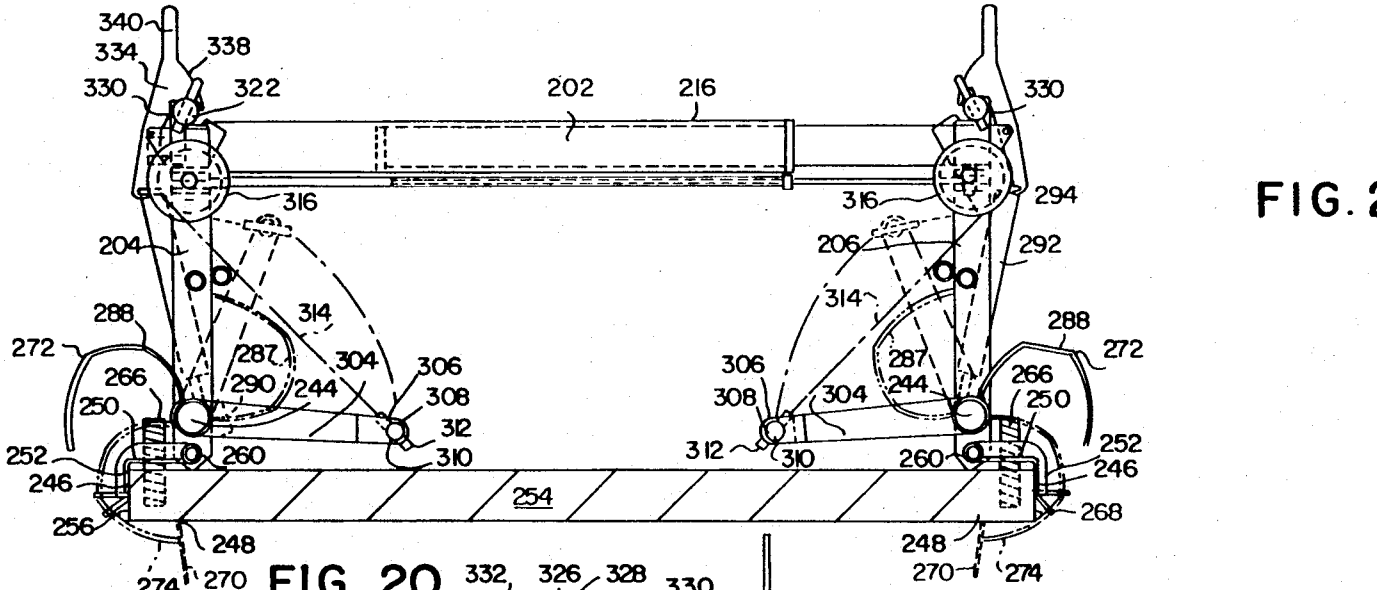
FIG. 20 is an enlarged end view of the tool shown in FIG. 17, and with the seal depressors rotated into positions depressing the seal strips and attached to the panel.

The shaft 244 and tines 272 are spring loaded to the released solid line position shown in FIGS. 17 and 20. In order to allow for the rotation of the shaft 244 and tines 272 to the attaching broken line positions of FIG. 20, the cam is fixed near each end of the spools 280 that are fixed between the legs 208 of each end frame 204 and 206. A push rod 296 of a tube 292 is fixed to the inside of each leg 208 for engaging a cam 290. The tube is positioned so the center line of the rod passes to the inside of the center line of the shaft 244 in order to effect a moment arm about the shaft 244. As shown in FIG. 20, the tubes 292 upper end 294 is tilted to the outside of beams 214 of the end frames 204 and 206 to provide clear access for insertion of the push rod 296 and a compression coil spring 302 into the tube (see FIG. 22).

The bottom of the tube 292 is spaced above the cam 290 to provide clearance at the highest throw position of the cam 290 (FIG. 22), and a washer 298 is attached to receive and guide the push rod 296. The interior of the top of the tube 284 is threaded to receive the matching thread of a spring loading plug 298. The plug 298 has a hole through it to receive and guide the top of the push rod 296, and the top portion of it is hex shaped to provide for the use of a wrench to install it. The rod 296 is of such length that when bearing against the cam 290 at the rods maximum downward travel point, it will protrude from the tube 292 a short distance.

A spring bearing washer 300 sized to fit inside of the tube 292 is fixed to the rod 296 at a short distance above the bottom of the tube 298 when the rod 296 is at its maximum downward travel point. The compression coil spring 302 is inserted to fit over the push rod 296 and inside of the tube 292. The spring 302 is of such length that when it is resting on the spring bearing washer 300 with the rod 296 at maximum downward travel, its top is a short distance inside the tube 292 so the plug 298 can be started into the threads at the top of the tube 294. The plug 298 is then screwed into the tube 292 to compress the spring 302 to apply a preload of the rod 296 against the cam 290 to rotate the shaft 244 to the position where the tines 272 are in the release position 288. The cam 290 is shaped so that rotation of the shaft 244 to depress the seal strips 70 pushes the rod 96 against the spring 302, creating an ever increasing spring pressure to return the tines 272 to the release solid line position 288.

In order to activate the rotation of the shaft 244 to depress the seal strips 270 a lever 304 is made a part of the spool 282 that is fixed to the shaft 244 just outside of each leg 208. When the tines 272 are in the release solid line (FIG. 20) position, the levers 304 are in a generally horizontal position. The end of the lever 304 is formed into a fork 306 and a hole is drilled through both prongs for the insertion of a rotatable pin 308, parallel to the main shaft 244. A hole 310 is drilled and tapped on the diagonal center line of the pin 308 to accept and anchor the threaded sleeve end 312 of an operating cable 314. Free rotation of the pin 308 provides for a straight pull of the cable 314 throughout the full swing of the lever 304.

A cable sheave 316 is mounted near the top of and on the outside of each leg 208. The sheave 316 is mounted on a cantilever shaft 318 which is fixed to a reinforcing base plate 320 which is in turn fixed to the leg 208 to position the sheave in the plane of the swing of the lever 304. A spreader bar 322 made of a piece of pipe a little longer than the distance between the two sheaves 316 on one end frame 204 or 206 is used on each end 204 and 206 to connect the lever operating cables 314 to a four legged wire rope sling 316 suspended from the handling crane. A hole is drilled in each end of each spreader 322 in the plane of the lever 304 and sheave 316 for the other threaded sleeve end 326 of the cables 314 to pass through and be anchored with a nut 328. A vertical plate barrier 230 is fixed to the top outer edge of the end frame 204 and 206 to prevent the spreader 322 from falling off of the end frame 204 and 206 under the pull of the cables 314. Bar loops 232 are fixed to the spreader 322 opposite the operating cable end 326 for making up to the sling 316 with shackles.

With the seal depressor set in place on a panel and the cables 314 and sling 316 rigged as above, the hoisting action of the crane first pulls the operating cables 314 over their sheaves 316 to rotate the levers 304, the shaft 244 to which they are fixed, and the tines 272 which are fixed to the shafts 244, to depress the seal strips 270 and contain and support the panel 254 in their grip by engaging its outer end edges, as shown in broken lines in FIG. 20. Continuation of the hoisting action lifts the panel which is then maneuvered to the desired position on the beams and set down. As the weight of the panel is transferred to the temporary support bolts 266, which have been lowered, continued lowering by the crane permits the spring load on the shaft 244 which causes it to rotate to the release position 288 with the spreader bars 322 bearing on the top of the end frames 204 and 206.

To allow the seal depressor to now be removed by the hoisting of the crane, the travel of the operating cables 314 must be prevented so they will not repeat the depressing of seal strips 270 and containment of the panel 254. To prevent the spreader bars 322 from moving, and thereby the cables 314, at this stage in the operation, a hinged hook 334 is attached to each end frame beam 214 near its center. When the hook 334 is rotated to the inside, it extends over the spreader bar 322 to prevent any movement of the bar, and when it is rotated outward, free movement of the spreader bar 322 is unobstructed. The hook 334 is lightly spring loaded in any suitable manner to the illustrated locked position and the shape of its upper inside edge 338 is such that when the spreader bar 322 is lowered under the force of the spring load of shaft 244, as a panel that has been placed is released, the spreader bar 322 will push the hook 334 back out of its way as it passes and the hook 334 will spring back to lock the bar 322 after it passes. A vertical extension 340 above the shaped edge 338 provides a handle for use in manually releasing the spreader bar 322. To permit the release of both spreader bars 322 by one man, the two hooks 334 are linked together. Preferably, the hooks are linked to one another for movement, together in response to actuation of only one of them.

Referring now to the details of the portion of the reinforced concrete deck shown in FIG. 23, a plurality of reinforced concrete support beams 400 extend longitudinally in laterally spaced apart rows, each row comprising end-to-end interior beams 400A and end beams 400B. Each of the beams 400A and 400B may be of identical construction, except that, for reasons to be described, the outermost ends of the end beams 400 have depressed top surfaces 401.

The deck construction shown in FIG. 23 also includes a plurality of reinforced concrete decking panels 402 arranged in laterally spaced apart, longitudinally extending rows and supported on support beams of adjacent rows thereof to span the space between them. More particularly, the longitudinally extending sides of the decking panels are supported on the tops of the longitudinal sides of the beams and are arranged, intermediate the ends of the support beams, in end-to-end engagement with one another to form a longitudinally spaced decking surface. The decking panels are preferably supported from the beams in a manner shown and described in an early part of this description wherein each such panel has a pair of threaded bolts 403 received through holes in the overhanging, longitudinally extending sides of the panels to engage at their lower ends with the top of the support beam.

As also shown in FIG. 23A, and as more fully described heretofore, seal strips 404 anchored to the lower sides of the decking panels for extension longitudinally thereof so as to engage the upper side edges of the support beams. As previously described, these strips are urged against the side edges of the beams to close the outer ends of the spaces between the lower sides of the decking panels and the tops of the support beams, and concrete or grout is placed therein either prior to or during pouring of a deck slab over the tops of the decking panels. As also previously described, the bolts 403 may be extended or retracted in order to adjust the grades of the top surfaces of the decking panels prior to pouring of the slab. As will be described to follow, however, this aspect of the present invention also anticipates that the decking panels may be supported on the support beams by more conventional means, such as shown and described in connection with FIGS. 1 to 3 of this application.

The deck shown in FIG. 23 also comprises a plurality of reinforced concrete forming panels 405 having their longitudinally extending side edges disposed between the longitudinally extending sides of the support beams and their laterally extending sides with their tops beneath the bottoms of the laterally extending ends of the decking panels 402. Thus, the forming panels span the space between the ends of the support beams to provide, with the tops of the beams, one upper surface on which the slab may be poured to a greater depth than it is poured above the decking panels.

For this purpose, a pair of hangers 406 are mounted on the longitudinally extending sides of the forming panels with their outer ends extending beyond such sides and thus overhanging the adjacent sides of the support beams so as to support the forming panels therefrom. For this purpose, and as will be described more fully hereinafter, the embodiment of each such hanger 406 includes a beam 407 which is connected intermediate its ends to the forming panel on which it is mounted by threaded bolts 408 whose upper ends are received through the threaded holes in beam 407 intermediate its ends and whose lower ends are received within aligned holes in the forming panels near their longitudinal sides. When so connected to the decking panels, the inner ends of the beams 407 engage with the tops of the forming panels, while the outer ends are tilted upwardly to positions above the top of the sides of the support beams.

More particularly, each such hanger includes second bolts 409 which extend threadedly through the outer ends of the beams to engage at their lower ends with the tops of the support beams. Thus, the bolts 409 may be manipulated to cause the inner ends of the beams to act as a fulcrum as the hanger beam is tilted to raise or lower the tops of the forming panels with respect to the support beams. As a result, it is possible to adjust the top surfaces of the forming panels to a desired grade prior to pouring of this slab.

Figure 23C:
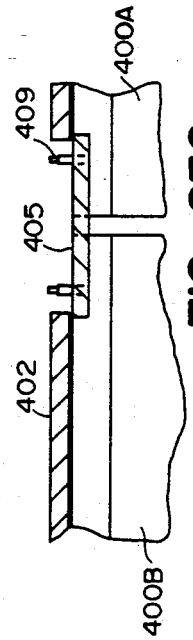
FIG. 23C is a further cross-sectional view, as seen along broken lines C—C of FIG. 23, showing the sides of adjacent, end-to-end support beams, and adjacent sides of decking and forming panels with the laterally extending end of the forming panels beneath the laterally extending end of the decking panels.
Figure 23E:
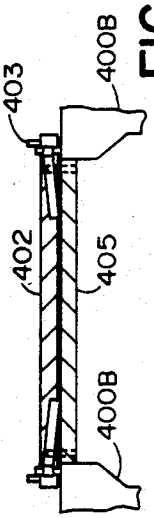
FIG. 23E is a cross-sectional view, as seen along broken lines E—E of FIG. 23, of portions of laterally spaced apart support beams and a decking panel supported therefrom as well as a forming panel having hangers mounted on its sides to support it with its longitudinally extending side edges closely adjacent the sides of the beams.
Figure 23D:
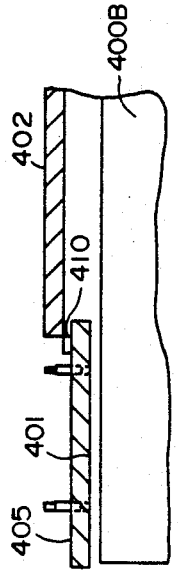
FIG. 23D is a still further cross-sectional view, as seen along broken lines D—D of FIG. 23, of the side of a support beam at one end of the bridge span, together with a decking panel having hangers to support one side thereof from the end of a beam with one laterally extending edge beneath the laterally extending edge of the decking panel.
Figure 23F:
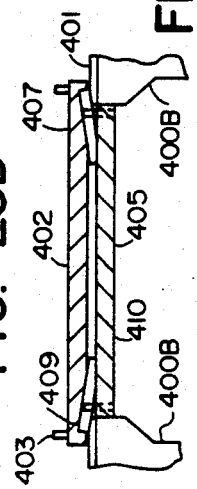
FIG. 23F is a cross-sectional view, as seen along broken lines F—F of FIG. 23, showing portions of a pair of laterally spaced apart support beams, together with a decking panel having its sides supported from the beams as well as a forming panel supported by hangers with its longitudinally extending edges closely adjacent the sides of the beams, as in the case of FIG. 23E, but differing from FIG. 23E in that the top of the forming panel is supported at a lower level and a strip of fiberboard or the like closes a space between the lower top of the forming panel and the bottom of the decking panel.
Figure 33:
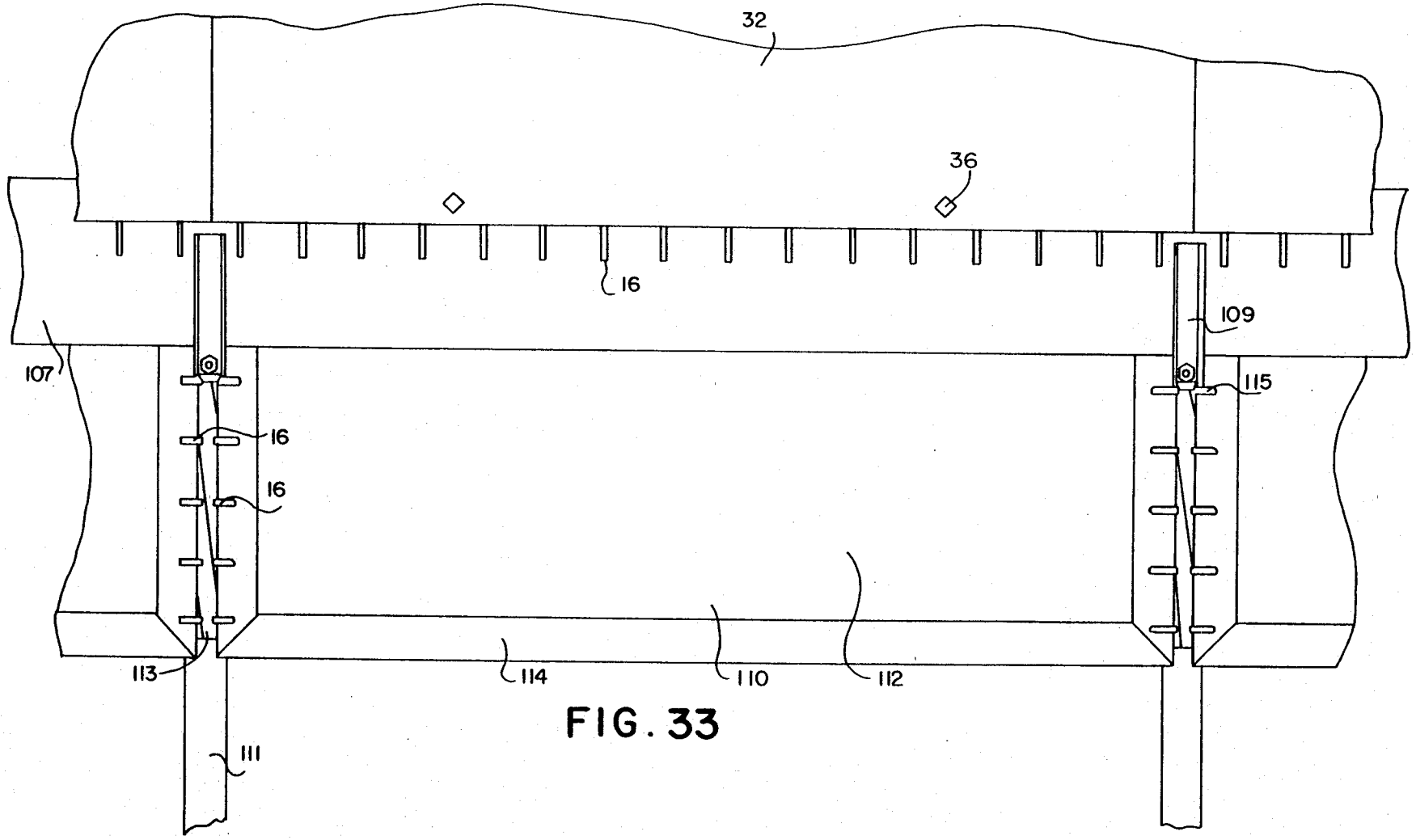
Figure 34:
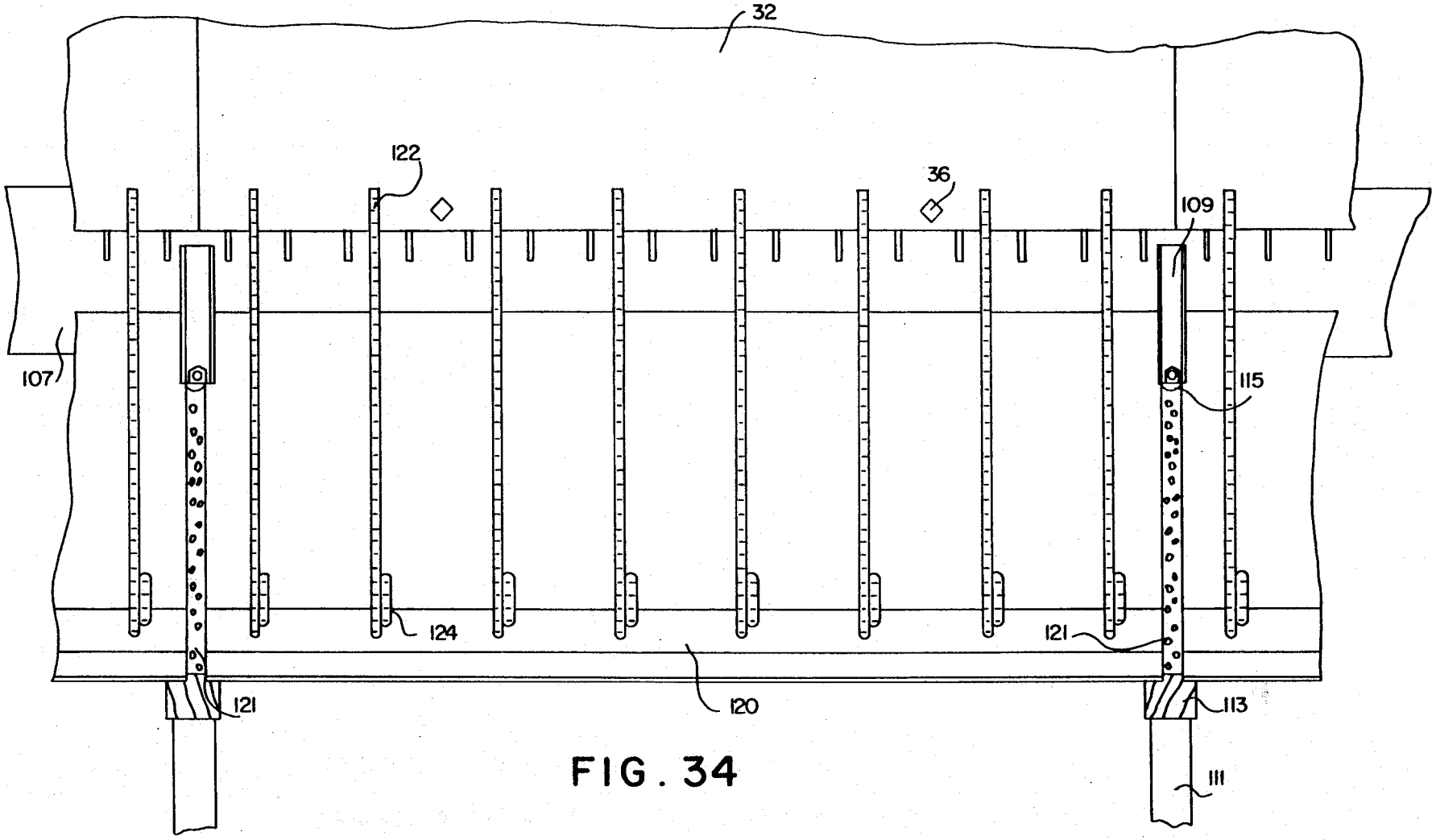
FIG. 34 is a top view of the panel shown in FIG. 14.

As best shown in FIGS. 23C and 23E, the top surfaces of the forming panels at the interior of the space are close to the bottom surfaces of the decking panels 402. However, as best down in FIGS. 33D and 33F, the top surfaces of the forming panels 405 which extend between the support beams 400B at the end of the beam are somewhat lower than those of adjacent decking panels and generally in horizontal alignment with the lowered support beam surfaces 401. As previously described, this permits the casting of a deeper and thus stronger slab at the ends of the span. The vertical spaces between the laterally extending ends of the decking panels 402 which overhang the laterally extending ends of the endmost decking panels 405 is closed by means of a strip 410 of fiberboard or other suitable material to prevent loss of concrete therebetween upon pouring of a slab over the decking panels and forming panel and the tops of the support beams.

In the construction of the reinforced concrete deck, the decking panels are first supported upon the support beams and their top surfaces are adjusted to a desired grade with respect to the finished deck by means of the bolts 403, as shown in FIG. 23A. Alternatively, the top surfaces of the decking panels may be brought to the desired grade in a manner described in connection with FIGS. 1 to 3, such as the disposal of longitudinally extending strips 411 within the space between the overhanging, longitudinally extending sides of the decking panels and the top surfaces of the sides of the support beams, as shown in FIGS. 24A and 24B.

Figure 24A:
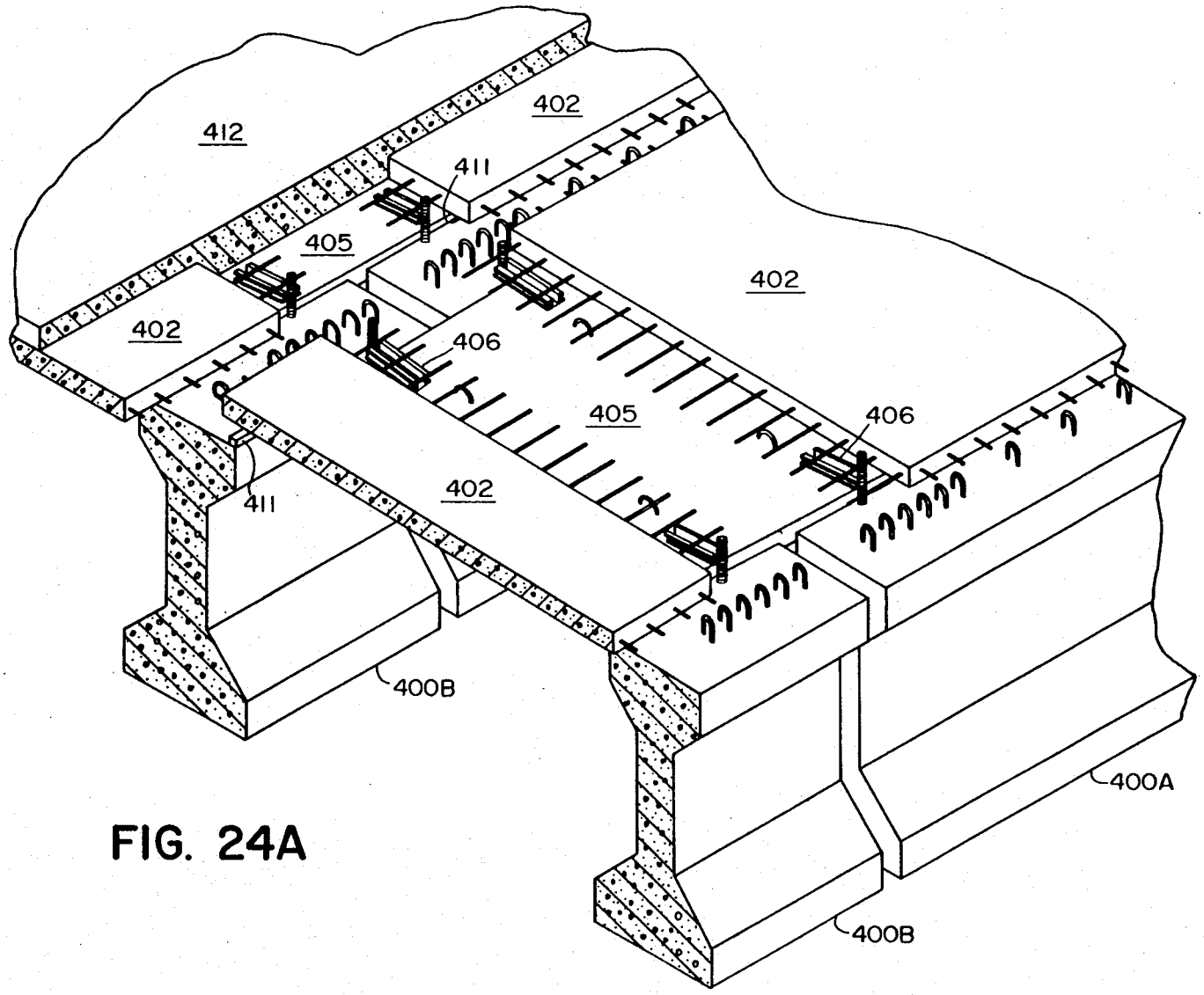
FIG. 24A is a perspective view of an intermediate portion of the bridge span shown in FIG. 23, as seen from the top and one side thereof, and showing the interior forming and decking panels as illustrated in FIGS. 23B and 23C, as well as a broken away portion of a slab poured in place over the tops of the support beams, decking panels and forming panels.
Figure 24B:
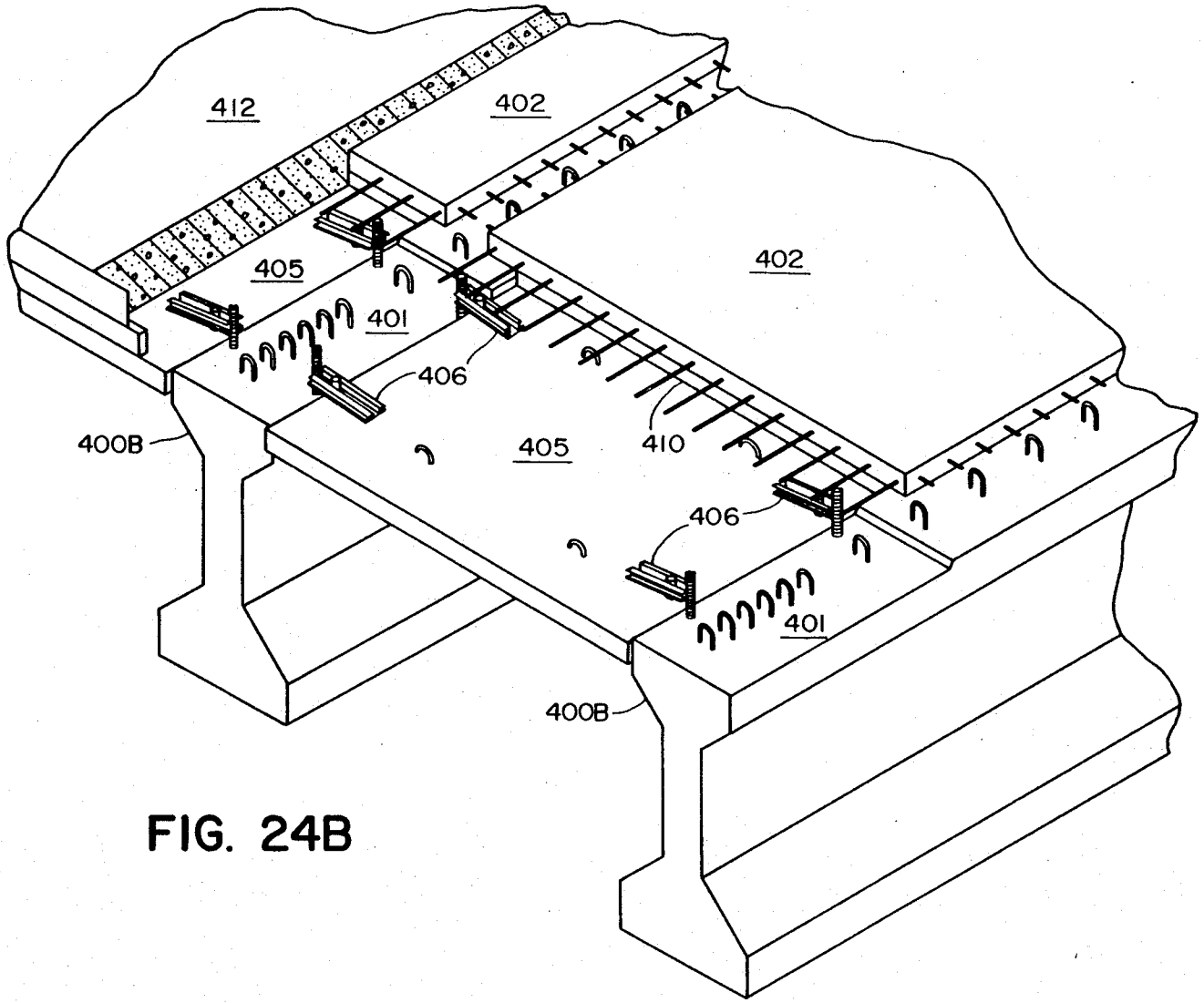
FIG. 24B is a perspective view similar to FIG. 23, but of an end portion of the bridge span and showing portions of the support beams, decking panels and forming panels illustrated in FIGS. 23D and 23F.

The detailed illustrations in FIGS. 24A and 24B show reinforcing bars extending from the ends of the decking panels as well as metal loops having their free ends embedded in the top surfaces of the support panels and support beams, as well as the construction and arrangement of the hangers 406 supporting the forming panels from the support beams in the positions shown. These figures further show a broken away portion of a concrete slab 412 which has been poured in place above the tops of the decking and forming panels as well as the support beams. As previously described, these figures differ in that the panels and the ends of the support beams shown in FIG. 24A are disposed at interior portions of the deck span, while whose of FIG. 24B are disposed at the end of the span. As previously described, the lowered top surfaces 401 of the outer ends of the support beams and forming panels shown in FIG. 24B enable the slab to be poured to a greater depth than the interior portions thereof, thus providing the deck with the desired lateral strength in these areas.

The beam 407 of the form of the forming panel of hanger 406 shown in the above described figures, and in particular in FIGS. 24A and 24B, is shown in FIGS. 25 and 35A to comprise a pair of spaced channels 412 connected by a lateral bar 413 at their inner ends and at their outer ends and intermediate their inner and outer ends by thread formers consisting of wire nuts 414 and 415 welded or otherwise secured to the inner sides of the channels. As shown in FIG. 25, the upper end of bolt 408 is threaded into the wire nut 415 and bolt 409 is threaded through the wire nut 414. As also shown in this figure, the lower end of bolt 408 is threaded into a thread former 416 within a hole through the forming panel 405 near its side adjacent support beam 400A to mount the hanger beam 406 with its inner end bearing on the top of the panel and its outer end extending over the side of the panel and above the top of the side of the support beam. More particularly, the beam is so connected to the panel as to be tilted with respect to the top surface of the panel 405 so that, as previously described, the inner end of the beam acts as a fulcrum as the bolt 409 is adjusted vertically within the wire nut 414 to raise or lower the forming panel with respect to the support beam, and thus raise the top surface of the forming panel to the desired grade.

The alternative hanger shown in FIG. 36, and indicated in its entirety by reference character 406A, is basically similar to hanger 406. Thus, it includes a beam 407 A and a bolt 408A which is threaded at its lower end for connection with a thread the former 416A in forming panel 405 near its longitudinally extending side edge. In this way, the beam is mounted on the panel with its inner end bearing on the top of the panel and its outer end extending over the side of the panel and above the top of the support beam 400A near its adjacent side.

More particularly, a second threaded bolt 409A is received through a threaded hole in a thread former 414A at the outer end of the beam so as to engage at its lower end with the top of the support beam. Thus, the inner end of beam 407A acts as a fulcrum to permit the panel 405 to be raised or lowered by manipulation of bolt 409A.

Beam 407A differs from beam 407 in that it is molded as a one-piece, plastic body with bolt 408A and the threads 414A to receive bolt 409A formed integrally therein. More particularly, the body of the beam 407A is molded in the shape of an I-beam having tubular parts in which the threads are formed to receive the bolt.

In conclusion, therefore, it is seen that the present invention and the embodiments disclosed herein are well adapted to carry out the objectives and obtain the ends set forth at the outset as well as others inherent therein. Certain changes can be made in the method and apparatus without departing from the spirit and the scope of this invention. While there have been described various embodiments of the present invention, the methods and apparatus described are not intended to be understood as limiting the scope of the invention. It is realized that changes therein are possible and it is further intended that each element recited in any of the following claims and each combination of elements is to be understood as referring to all equivalent elements or combinations for accomplishing substantially the same results in substantially the same or equivalent manner. It is intended that the claims cover the invention broadly in whatever form its principles may be utilized.

What is claimed is:

1. For use in locating one side of a precast reinforced concrete panel with respect to an adjacent surface, an interiorly threaded tubular member which is open at both ends, means on the member for securing it to longitudinally extending reinforcing strands within a bed in which the panel is to be cast so that the upper and lower ends of the member will be adjacent the opposite sides of the panel, when cast, and for spacing the member a predetermined lateral distance from an end of the bed and thus an end of the panel, a bolt adapted to be threadedly received in the member for axial extension from one end thereof into engagement with the surface in order to locate one side of the panel a desired distance from the surface.

2. As in claim 1, including a cap removably mountable on the other end of the member to close same.

3. As in claim 1, wherein said securing means includes arms on opposite sides of the member, one end of each arm having a finger shaped to wrap around a strand, and the other end of each arm having a finger which is bendable about an adjacent strand.

4. As in claim 1, wherein said securing means includes arms on opposite sides of the tubular member, one end of each arm having a semicircular ring for gripping a strand.

5. As in claim 1, wherein the member is spaced by gage rods extending laterally from the arms for engaging the end of the bed.

6. A panel comprising a body of precast concrete having longitudinally extending reinforcing strands embedded therein, a thread former comprising an interiorly threaded, open ended tubular member cast into the body and having open ends adjacent opposite sides of the panel, a bolt adapted to be threadedly received in the body for axial extension from one end of the body in order to engage and threrby locate one side of the body a desired distance from a support surface, and means on the member securing it to adjacent strands in a bed in which the body is cast so that the upper and lower ends of the member will be adjacent the opposite sides of the panel, when cast, and for spacing the member a predetermined lateral distance from an end of the bed and thus an end of the panel.

7. As in claim 6, including a cap removably mountable on the other end of the member to close same.

8. As in claim 6, wherein said securing means includes arms on opposite sides of the member, one end of each arm having a finger shaped to rest on a strand, and the other end of each arm having a finger which is bendable about an adjacent strand.

9. As in claim 6, wherein said securing means includes arms on opposite sides of the tubular member, one end of each arm having a semicircular ring for gripping a strand.

10. As in claim 6, wherein the member is spaced by gage rods extending laterally from the arms for engaging the end of the bed.

* * * * *